US010363526B2

(12) United States Patent
Pappalardo et al.

(10) Patent No.: US 10,363,526 B2
(45) Date of Patent: Jul. 30, 2019

(54) ENTRY MIXING ELEMENTS AND RELATED STATIC MIXERS AND METHODS OF MIXING

(71) Applicant: Nordson Corporation, Westlake, OH (US)

(72) Inventors: Matthew E. Pappalardo, Ewing, NJ (US); Robert W. Springhorn, Cream Ridge, NJ (US)

(73) Assignee: Nordson Corporation, Westlake, OH (US)

( * ) Notice: Subject to any disclaimer, the term of this patent is extended or adjusted under 35 U.S.C. 154(b) by 353 days.

(21) Appl. No.: 15/066,319

(22) Filed: Mar. 10, 2016

(65) Prior Publication Data

US 2017/0036179 A1 Feb. 9, 2017

Related U.S. Application Data

(60) Provisional application No. 62/202,554, filed on Aug. 7, 2015.

(51) Int. Cl.

| | |
|---|---|
| ***B01F 5/06*** | (2006.01) |
| ***B01F 13/00*** | (2006.01) |
| ***B01F 3/10*** | (2006.01) |

(52) U.S. Cl.

CPC ..... *B01F 5/0606* (2013.01); *B01F 3/10* (2013.01); *B01F 5/0641* (2013.01); *B01F 13/0023* (2013.01); *B01F 2215/0039* (2013.01)

(58) Field of Classification Search

CPC ..... B01F 5/064; B01F 5/0641; B01F 5/0642; B01F 5/0606; B01F 5/0612; B01F 2215/006

(Continued)

(56) References Cited

U.S. PATENT DOCUMENTS 1,648,708 A 11/1927 Wilkinson
3,239,197 A 3/1966 Tollar (Continued)

FOREIGN PATENT DOCUMENTS

CH 699958 A1 5/2010
EP 0749776 A1 12/1996

(Continued)

OTHER PUBLICATIONS

International Application No. PCT/US2016/045239: Invitation to Pay Additional Fees dated Nov. 15, 2016, 8 pages.

(Continued)

*Primary Examiner* — Tony G Soohoo
*Assistant Examiner* — Elizabeth Insler
(74) *Attorney, Agent, or Firm* — Baker & Hostetler LLP

(57) ABSTRACT

An entry mixing element is provided for mixing an incoming fluid flow having first and second unmixed components arranged so as to define a transverse flow cross-section perpendicular to a flow direction. The entry mixing element includes a central axis configured to be aligned with the flow direction of the incoming fluid flow, and an entry dividing wall extending parallel to the central axis and positioned to divide the incoming fluid flow into first and second fluid flow portions, each portion containing an amount of the first component and an amount of the second component. The entry dividing wall is configured to divide the incoming fluid flow into the first and second fluid flow portions in any rotational orientation of the entry mixing element about its central axis relative to the transverse flow cross-section of the incoming fluid flow. Related static mixers and methods of mixing are also provided.

13 Claims, 19 Drawing Sheets

(58) Field of Classification Search
USPC ..... 366/336, 337, 340
See application file for complete search history.

(56) References Cited

U.S. PATENT DOCUMENTS

| | | | | |
|---|---|---|---|---|
| 3,406,947 | A | 10/1968 | Harder et al. | |
| 3,424,437 | A | 1/1969 | Shearer et al. | |
| 4,538,920 | A | 9/1985 | Drake | |
| 5,487,606 | A | 1/1996 | Keller | |
| 5,498,078 | A | 3/1996 | Keller | |
| 5,851,067 | A * | 12/1998 | Fleischli ..... | B01F 5/0617 366/337 |
| 5,944,419 | A | 8/1999 | Streiff | |
| 6,599,008 | B2 | 7/2003 | Heusser et al. | |
| 6,773,156 | B2 | 8/2004 | Henning | |
| 7,325,970 | B2 | 2/2008 | Keller | |
| 7,841,765 | B2 | 11/2010 | Keller | |
| 7,985,020 | B2 | 7/2011 | Pappalardo | |
| 8,083,397 | B2 | 12/2011 | Pappalardo | |
| 9,046,115 | B1 | 6/2015 | England et al. | |
| 2013/0135963 | A1 | 5/2013 | Linne et al. | |

FOREIGN PATENT DOCUMENTS

| | | | |
|---|---|---|---|
| EP | 0815929 | A1 | 1/1998 |
| EP | 1125626 | A1 | 8/2001 |
| EP | 1426099 | A1 | 6/2004 |
| EP | 2133138 | A1 | 12/2009 |
| EP | 2599540 | A1 | 6/2013 |
| EP | 3059006 | A1 | 8/2016 |
| JP | 55145522 | A | 11/1980 |
| WO | 2011162728 | A1 | 12/2011 |

OTHER PUBLICATIONS

International Application No. PCT/US2016/045239: International Search Report and the Written Opinion dated Feb. 20, 2017, 19 pages.
International Application No. PCT/US2016/045281: International Search Report and the Written Opinion dated Nov. 15, 2016, 13 pages.
International Patent Application No. PCT/US2016/045281; Int'l Preliminary Report on Patentability; dated Feb. 22, 2018; 8 pages.
International Patent Application No. PCT/US2016/045239; Int'l Preliminary Report on Patentability; dated Feb. 22, 2018; 11 pages.

* cited by examiner

ENTRY MIXING ELEMENTS AND RELATED STATIC MIXERS AND METHODS OF MIXING

CROSS-REFERENCE TO RELATED APPLICATION

This application claims priority to U.S. Provisional Application Ser. No. 62/202,554, filed Aug. 7, 2015, the disclosure of which is hereby incorporated by reference herein in its entirety.

TECHNICAL FIELD

This disclosure generally relates to fluid dispensers, and more particularly, to static mixers and methods of mixing multi-component fluid flows.

BACKGROUND

A variety of static mixer types exist for mixing together multiple components of a fluid flow received from fluid cartridges, such as side-by-side fluid cartridges, or similar dispensing devices. Generally, conventional mixers mix the components of the fluid flow together by continuously dividing and recombining the components in an overlapping manner. This mixing is achieved by directing the fluid components along a mixing component structure that includes a series of mixing elements (also referred to as "mixing baffles") of alternating geometry. Such division and recombination creates alternating layers of the fluid components. In this manner, the streams of the fluid components are progressively thinned and diffused, thereby creating a generally homogenous mixture of the fluid components at the mixer outlet. While such mixers are generally effective to mix a majority of the mass of the incoming fluid components, mixers are often subject to a streaking phenomenon in which streaks of one of both of the fluid components are left completely unmixed in the final mixture extruded at the mixer outlet.

The mixing element arranged at the inlet end of a mixer is generally referred to as an entry mixing element, or initial mixing element, and it provides some initial division of the incoming fluid flow directed into the static mixer. The effectiveness of conventional entry mixing elements in providing a degree of initial mixing sufficient to mitigate streaking is dependent upon proper rotational alignment of the entry mixing element relative to a transverse flow cross-section of the incoming fluid flow. For example, FIG. 1A shows a conventional mixing component 1 and its entry mixing element 2 positioned in a non-optimal rotational orientation relative to a transverse flow cross-section of an incoming fluid flow containing fluid component 3 (the other component(s) not being shown). As shown in FIG. 1A, the fluid component 3 is not fully divided by the entry mixing element 2, thereby resulting in undesired streaking of the fluid component 3 in the mixture extruded at the mixer outlet. By comparison, FIG. 1B shows the mixing component 1 and its entry mixing element 2 positioned in an optimal rotational orientation relative to a transverse flow cross-section of the incoming fluid flow, such that fluid component 3 is divided into at least first and second portions and streaking in the extruded mixture is thereby substantially averted.

For many static mixers, the mixer conduit includes an integrally formed nut for threadedly attaching the mixer to a fluid cartridge or similar dispensing device. As the mixer is threaded onto the cartridge, the mixing component often rotates with the mixer conduit relative to the cartridge. Thus, the final rotational orientation of the mixing component relative to the fluid outlets of the cartridge, and thus to a transverse flow cross-section of the fluid flow to be mixed, is dependent on the degree to which the user tightens the mixer onto the cartridge. Different users, or even the same user, may rotate a particular mixer to inconsistent final rotational orientations when tightening the mixer. Consequently, and undesirably, mixing performance of the entry mixing element may vary significantly from user to user, and even from use to use by the same user.

Accordingly, there is a need for improvements to known entry mixing elements and corresponding static mixers that address these and other shortcomings of known entry mixing elements and static mixers.

SUMMARY

In an exemplary embodiment of the invention, an entry mixing element is provided for mixing an incoming fluid flow having first and second unmixed components arranged so as to define a transverse flow cross-section perpendicular to a flow direction of the incoming fluid flow. The entry mixing element includes a central axis configured to be aligned with the flow direction of the incoming fluid flow, and an entry dividing wall extending parallel to the central axis. The entry dividing wall is positioned to divide the incoming fluid flow into a first fluid flow portion and a second fluid flow portion, each of the first and second fluid flow portions containing an amount of the first component and an amount of the second component. Advantageously, the entry dividing wall is configured to divide the incoming fluid flow into the first and second fluid flow portions in any rotational orientation of the entry mixing element about its central axis relative to the transverse flow cross-section of the incoming fluid flow.

In another exemplary embodiment of the invention, a method is provided for mixing first and second components of a fluid flow with a static mixer including a mixer conduit and a mixing component having an entry mixing element and a plurality of mixing baffles arranged downstream of the entry mixing element. The method includes introducing the fluid flow having first and second components into an inlet end of the mixer conduit, the first and second components being arranged so as to define a transverse flow cross-section perpendicular to a flow direction of the fluid flow. The method further includes forcing the fluid flow into contact with the entry mixing element. More specifically, the fluid flow is divided with an entry dividing wall into a first fluid flow portion and a second fluid flow portion, each of the first and second fluid flow portions containing an amount of the first component and an amount of the second component. Subsequently, the first and second fluid flow portions are recombined to form a mixture of the first and second components. The mixture is directed downstream of the entry mixing element to be mixed further by the mixing baffles. Advantageously, the entry mixing element is configured to divide the fluid flow into the first and second fluid flow portions in any rotational orientation of the entry mixing element about its central axis relative to the transverse flow cross-section of the fluid flow.

Various additional features and advantages of the invention will become more apparent to those of ordinary skill in the art upon review of the following detailed description of one or more illustrative embodiments taken in conjunction with the accompanying drawings.

DETAILED DESCRIPTION

Figure 1A:
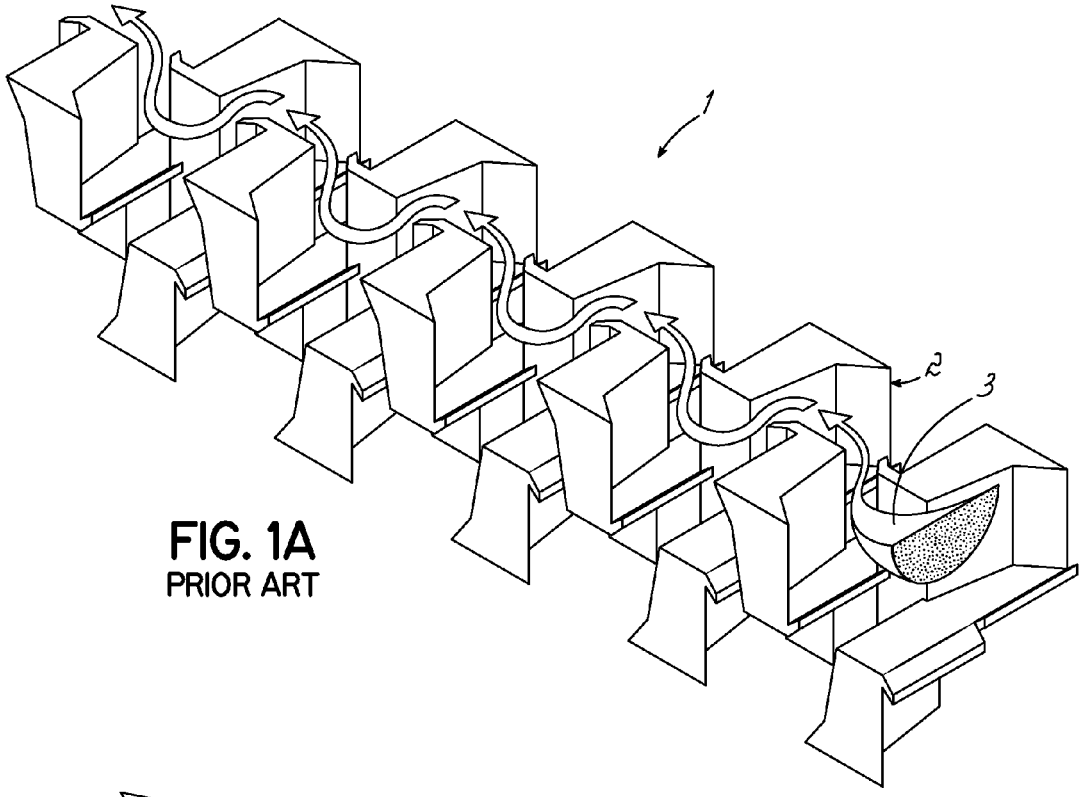
FIG. 1A PRIOR ART
FIG. 1A is a front perspective view of a mixing component of a conventional static mixer, shown in a non-optimal rotational orientation relative to an incoming fluid flow, resulting in streaking of a component of the fluid flow.
Figure 1B:
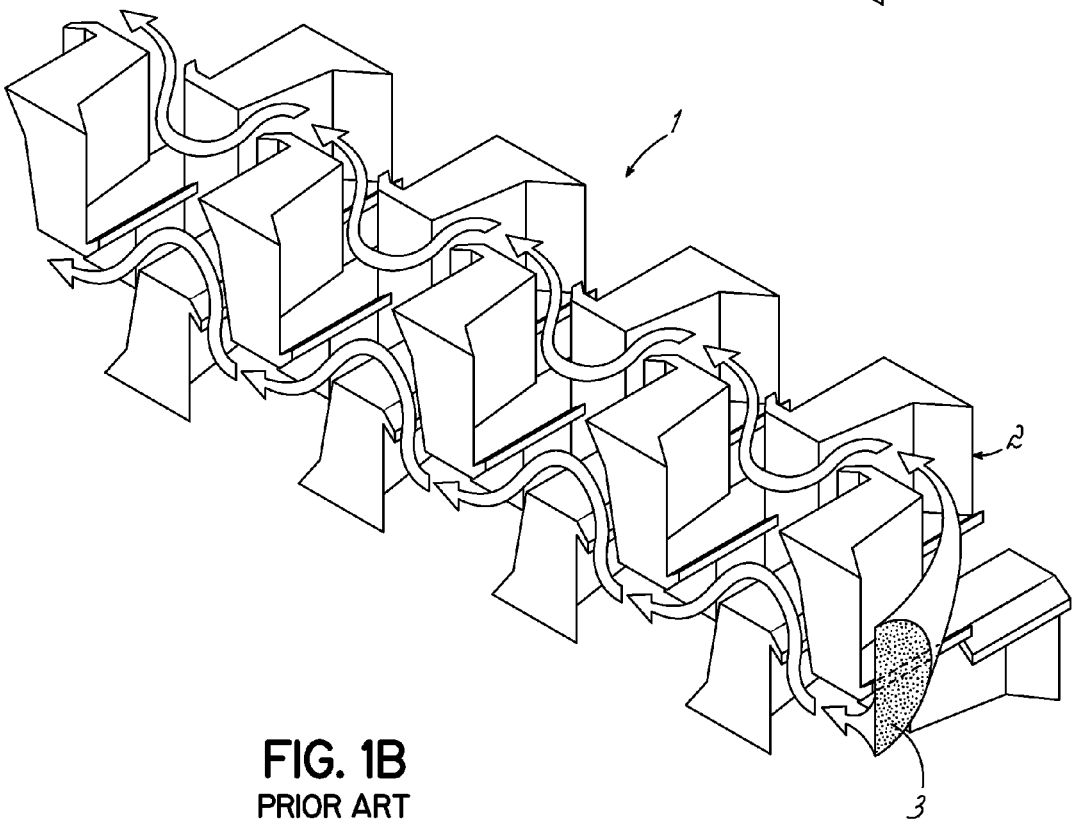
FIG. 1B PRIOR ART
FIG. 1B is a front perspective view similar to FIG. 1A, showing the mixing component in an optimal rotational orientation relative to the incoming fluid flow, which reduces risk of streaking.
Figure 2:
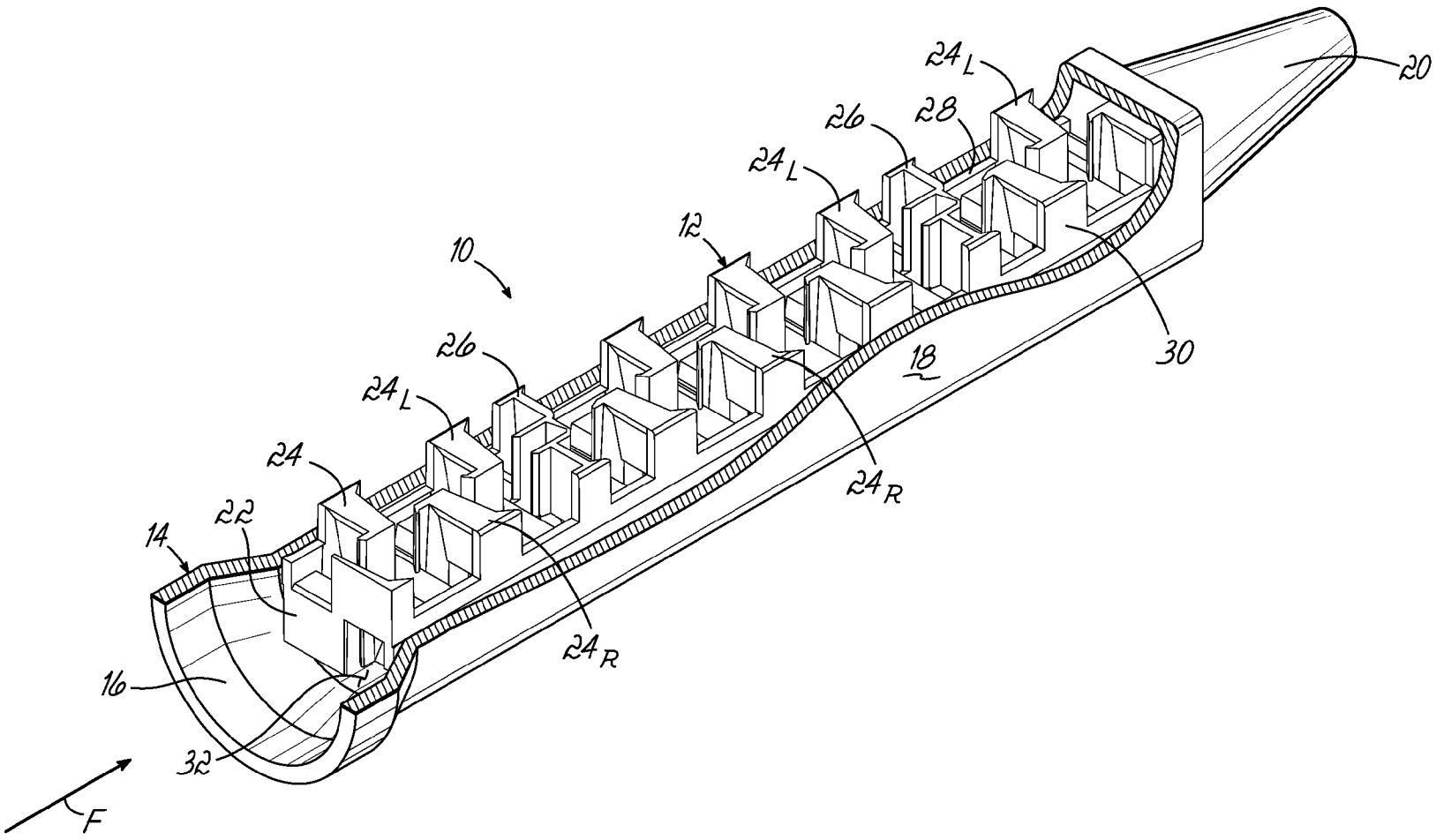
FIG. 2 is a front perspective view of a static mixer including a mixing component having an entry mixing element according to an exemplary embodiment of the invention.
Figure 3:
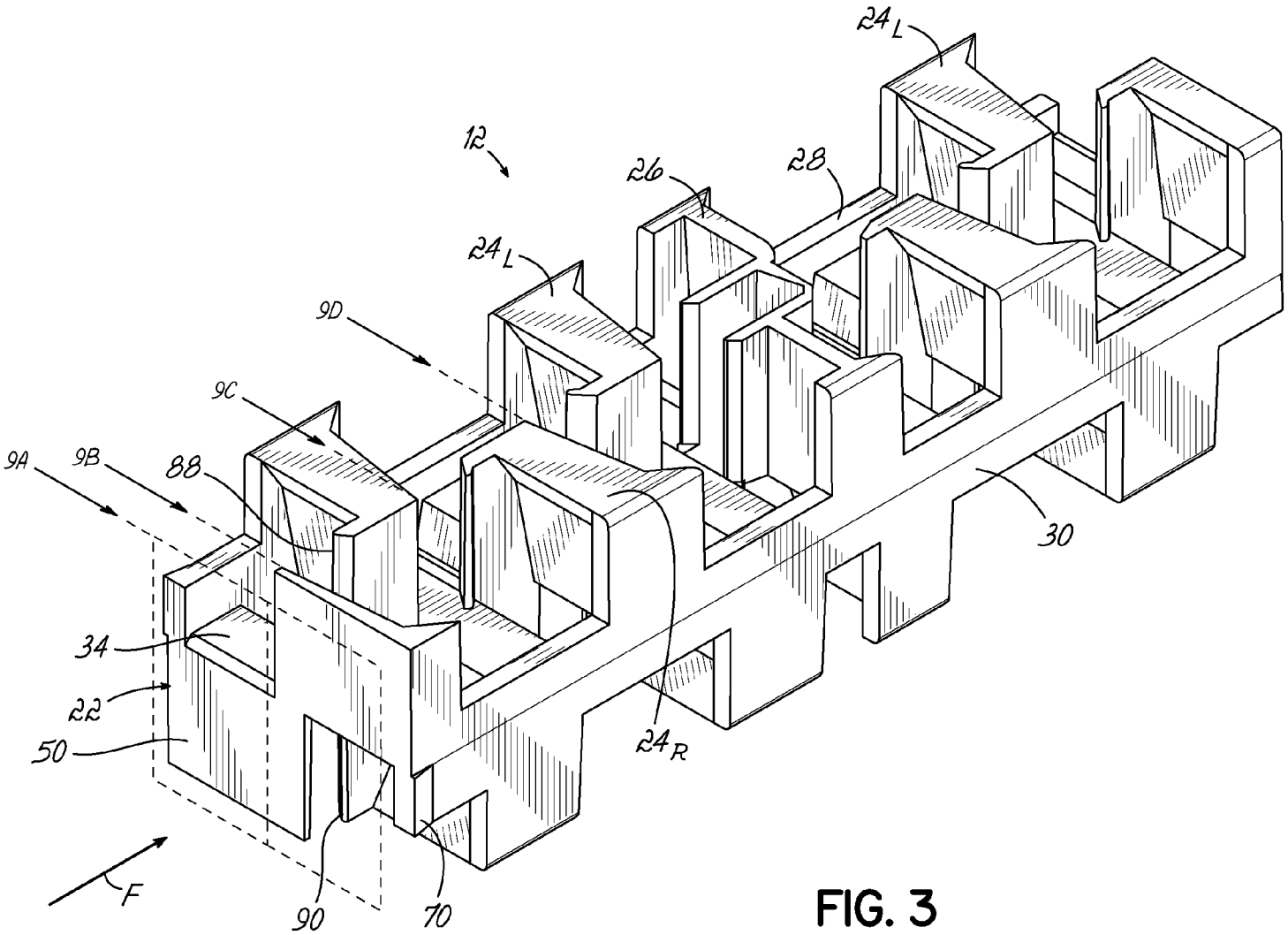
FIG. 3 is a front perspective view of the mixing component of FIG. 2.
Figure 4:
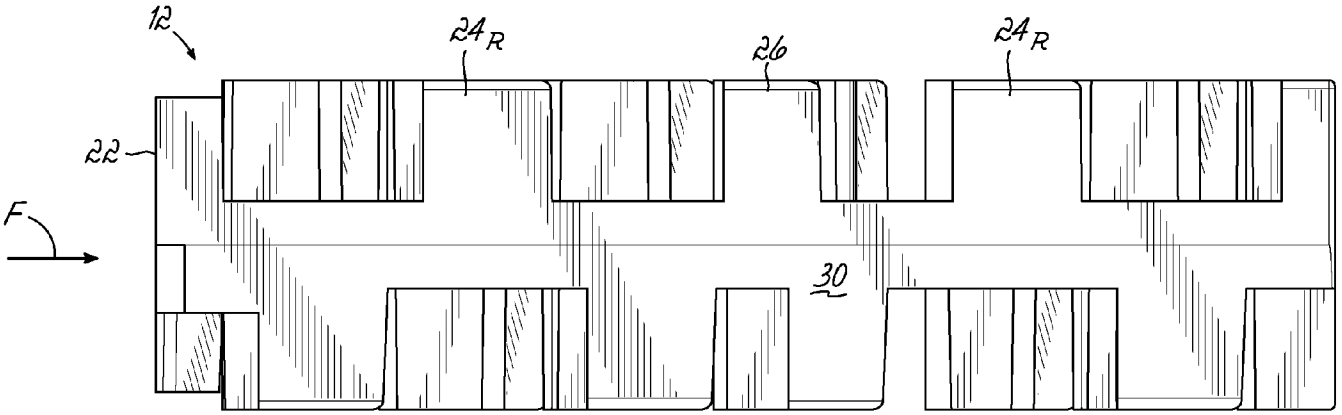
FIG. 4 is a side elevation view of the mixing component of FIG. 3.
Figure 5:
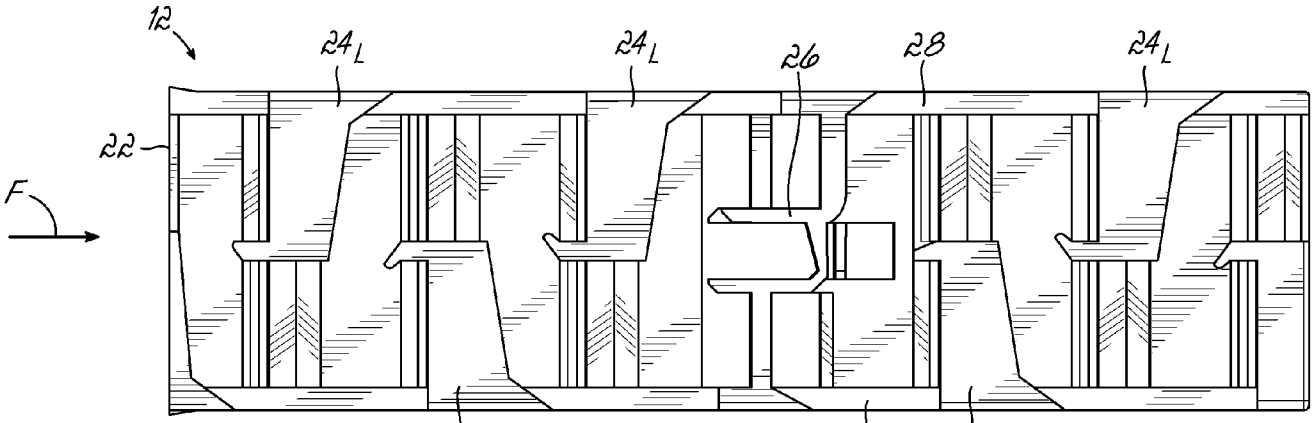
FIG. 5 is a top view of the mixing component of FIG. 3.

Referring to FIGS. 2 and 3, a static mixer 10 according to an exemplary embodiment of the invention is shown. The static mixer 10 includes a mixing component 12 having a series of mixing elements (or "baffles") for dividing, shifting, and recombining multiple components of an incoming fluid flow F in various manners along a length of the static mixer 10. These various mixing elements function together to thoroughly mix the multiple components of the fluid flow F, and thereby minimize streaks of unmixed fluid components in the fluid mixture extruded at an outlet 20 of the mixer 10.

The static mixer 10 includes an outer conduit 14 in which the mixing component 12 is received. The conduit 14 defines an inlet end socket 16 configured to be attached to a cartridge, cartridge system, or metering system (none of which are shown) containing at least two fluid components to be mixed together. For example, the inlet end socket 16 may be connected to any of the two-component cartridge systems made available by Nordson Corporation. The conduit 14 includes a body section 18 shaped to receive the mixing component 12, and a nozzle outlet 20 extending from the body section 18. Although the body section 18 and mixing component 12 are shown as having substantially square cross-sectional profiles, those skilled in the art will appreciate that various alternative cross-sectional shapes may also be suitable, such as circular or generally rounded, for example.

Figure 9A:
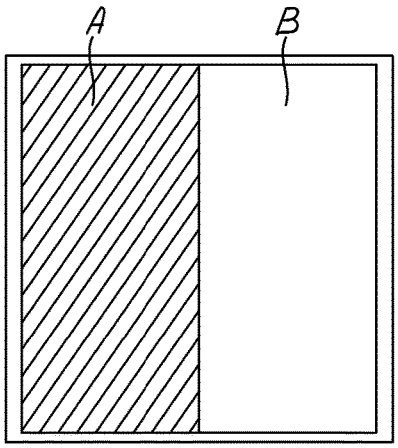
FIG. 9A is a flow cross-section taken at line 9A-9A shown in FIG. 3.

The series of mixing elements of the mixing component 12 begins with an entry mixing element 22 arranged adjacent to the inlet end socket 16 to contact the incoming fluid flow F as it is directed into the static mixer 10. The multiple, unmixed components of the incoming fluid flow F are arranged so as to define a transverse flow cross-sectional perpendicular to a flow direction of the fluid flow, as shown in FIG. 9A, for example. Advantageously, the entry mixing element 22 ensures some initial division and mixing of each of the multiple components of the fluid flow F regardless of the rotational orientation of the entry mixing element 22, about a central axis of the mixing component 12, relative to the transverse flow cross-section of the incoming fluid flow F.

The mixing component 12 further includes a series of mixing baffles 24 arranged downstream of the entry mixing element 22, shown in the form of alternating left-handed and right-handed versions (labeled $\mathbf{24}_L$ and $\mathbf{24}_R$, respectively). Each double wedge mixing baffle 24 functions to divide the fluid flow at a leading edge of the mixing baffle 24, and then shift or rotate the flow clockwise or counterclockwise through a partial rotation before expanding and recombining the fluid flow at a trailing edge of the mixing baffle 24.

The mixing component 12 may further include one or more flow shifter elements 26, for example arranged after each set of several double wedge mixing baffles 24 in the series of mixing elements. The flow shifter element 26 is configured to shift at least a portion of the fluid flow from one side of the conduit 14 to another side of the conduit 14, thereby providing a different type of fluid movement and mixing contrasting with the double wedge mixing baffles 24.

FIGS. 3-6 show a partial portion of the exemplary mixing component 12, separated from the remainder of the static mixer 10. The series of mixing elements and baffles 22, 24, 26 defining the mixing component 12 are integrally molded with one another so as to define first and second sidewalls 28, 30 of the mixing component 12. The first and second sidewalls 28, 30 at least partially bound opposite sides of the mixing component 12, whereas the other sides of the mixing component 12 extending between the first and second sidewalls 28, 30 remain largely open or exposed to an associated interior surface 32 of the conduit 14 (one of the interior surfaces is cut away and not shown in FIG. 2). The total quantity of mixing elements 24, 26 may vary in different embodiments of the mixer 10. Moreover, it will be understood that the static mixer 10 is merely an exemplary mixer in which the entry mixing element 22 is implemented.

Figure 6:
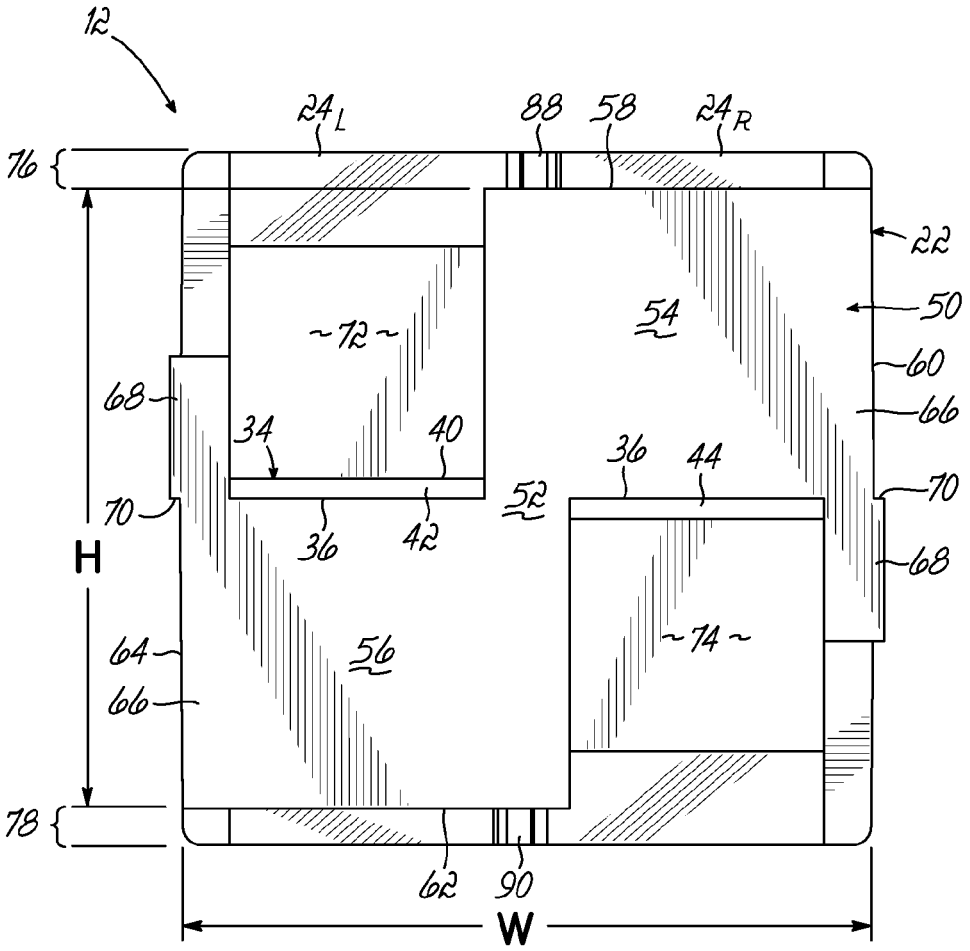
FIG. 6 is a front elevation view of the mixing component of FIG. 3, showing additional details of the entry mixing element.
Figure 7:
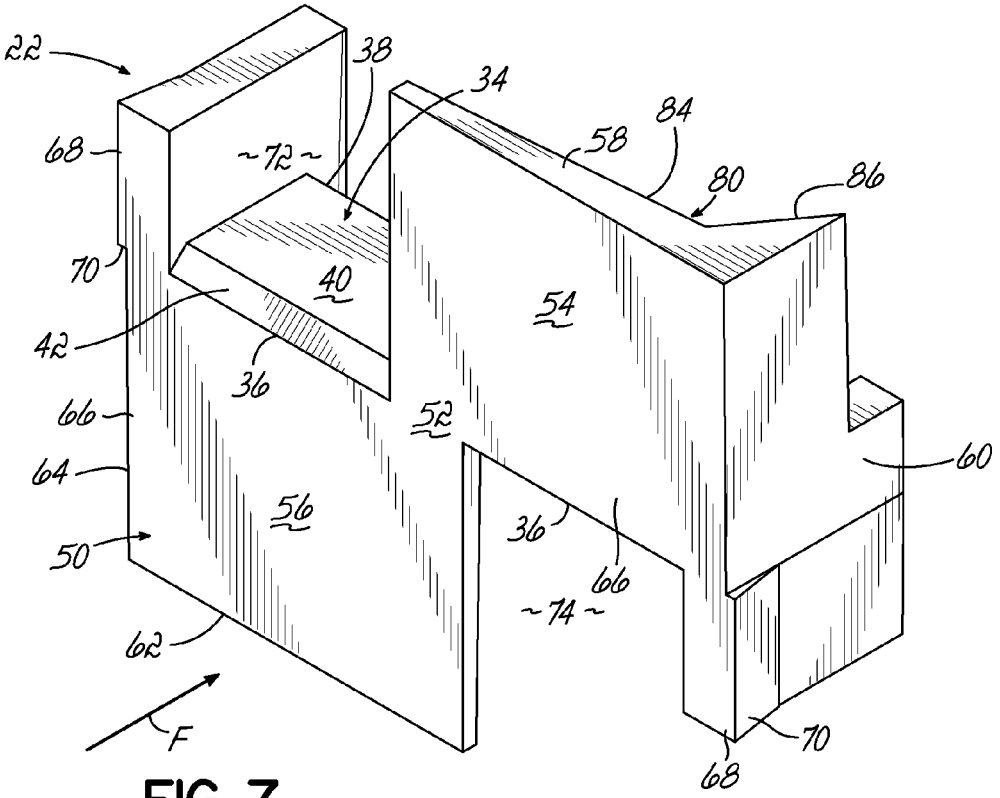
FIG. 7 is a front perspective view of the entry mixing element of FIG. 2.
Figure 8:
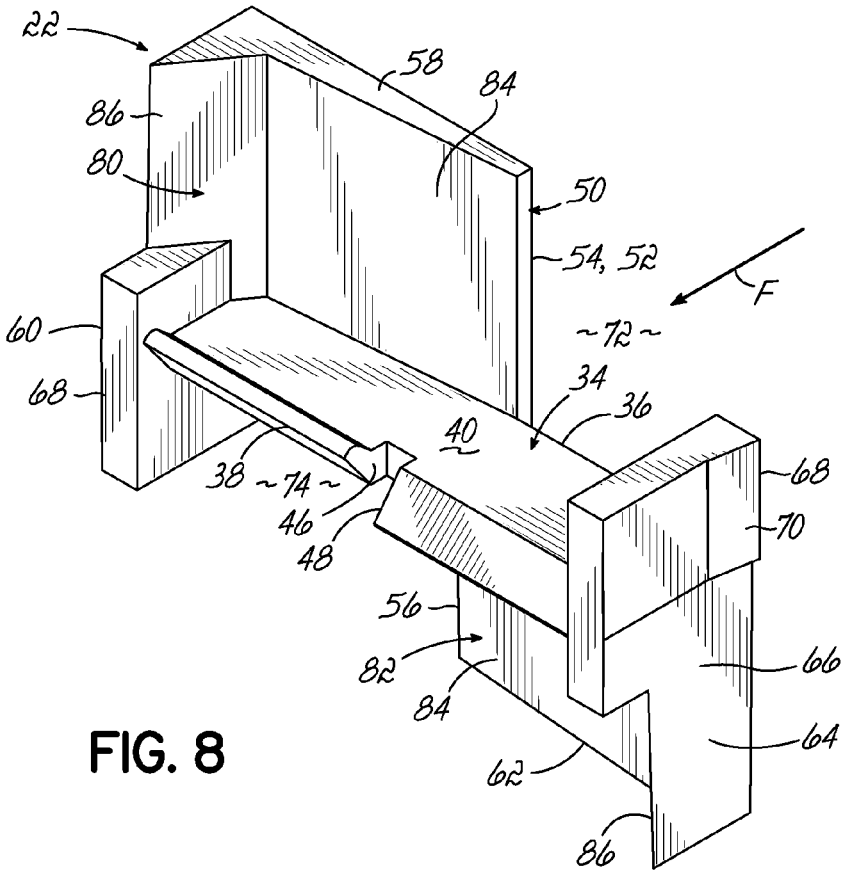
FIG. 8 is a rear perspective view of the entry mixing element of FIG. 2.

Referring to FIGS. 6-8, features of the entry mixing element 22 are shown in greater detail. The entry mixing element 22 advantageously provides initial division and mixing of each of first and second fluid components of the incoming fluid flow F in every possible rotational orientation of the entry mixing element 22, about a central axis of the static mixer 10, relative to the transverse flow cross-section of the incoming fluid flow F. In order words, the entry mixing element 22 is effective to provide this initial division and mixing regardless of the degree to which the static mixer 10 is threaded onto a fluid cartridge (not shown) or similar dispensing device from which the fluid flow F is directed.

As described in greater detail below, the entry mixing element 22 mixes the incoming fluid flow F by dividing the fluid flow F into at least first and second fluid flow portions, each containing an amount of the unmixed first and second components of the incoming fluid flow F. The entry mixing element 22 then recombines the first and second fluid flow portions and directs the mixture downstream to be mixed further by additional mixing elements, such as mixing baffles 24 and flow shifter elements 26. In this manner, the initially unmixed components of the incoming fluid flow F are sufficiently mixed to form a homogenous mixture by the time they reach the mixer outlet, and undesirable streaking of one or both of the fluid components in the extruded mixture is substantially prevented.

It will be appreciated that the orientation-based labels used below, such as "vertical," "horizontal," "left," "right," "top," "bottom," "upper," "lower," "upward," "downward," and similar terms, as used in reference to elements of the exemplary embodiments shown in the Figures, are for illustrative purposes only and refer to the exemplary orientations of these elements as shown in the Figures. Further, it will be appreciated that the embodiments shown may be oriented in a variety of alternative orientations that are encompassed within the scope of this disclosure. Accordingly, the orientation-based labels used herein are not intended to limit the scope of the invention to any particular orientation of the embodiments.

As shown best in FIGS. 6-8, the entry mixing element 22 includes an entry dividing wall 34 that extends in a generally horizontal direction and includes a leading edge 36 that faces the incoming fluid flow F, a trailing edge 38, a planar upper surface 40, and an opposed planar lower surface (not shown). The leading edge 36 is defined by a left front angled surface 42 that extends angularly downward from the upper surface 40, and further by a right front angled surface 44 that extends angularly upward from the bottom surface. The trailing edge 38 is defined by first and second hook sections 46, 48, described in greater detail below.

The entry mixing element 22 further includes a planar front panel 50 defining a planar front surface 52 that extends vertically and generally transverse to the entry dividing wall 34 and to a longitudinal axis of the mixer 10. The front panel 50 includes an upper front panel portion 54 extending primarily in the upper right quadrant of the entry mixing element 22, and an integrally formed lower front panel portion 56 extending primarily in the lower left quadrant of the entry mixing element 22. The upper front panel portion 54 defines a top 58 and a right side 60 of the entry mixing element 22, and the lower front panel portion 56 defines a bottom 62 and a left side 64 of the entry mixing element 22.

The upper and lower front panel portions 54, 56 are formed with similar constructions, each including a body 66 and a leg 68 extending therefrom. The leg 68 of the upper front panel portion 54 extends downwardly into the lower right quadrant, while the leg 68 of the lower front panel portion 56 extends upwardly into the upper left quadrant. Each of the legs 68 includes a wedge 70 that projects outwardly from the respective right and left sides 60, 64 of the entry mixing element 22. As shown in FIG. 6, the wedges 70 project outwardly beyond the sides of the mixing baffles 24 located downstream of the entry mixing element 22.

An upper fluid gate 72 is defined in the upper left quadrant of the planar front panel 50 between the body 66 of the upper front panel portion 54 and the leg 68 of the lower front panel portion 56. A lower fluid gate 74 is defined in the lower right quadrant between the body 66 of the lower front panel portion 56 and the leg 68 of the upper front panel portion 54.

As shown best in FIG. 6, the planar front panel 50 of the mixing element 22 is formed with a height H defined by the perpendicular distance between the top 58 and the bottom 62. Further, the planar front panel 50 is formed with a width W defined by the perpendicular distance between the right side 60 and left side 64. As shown, the entry mixing element 22 may be formed such that its height H is less than its width W, thereby defining an imaginary outer periphery having a non-square rectangular shape. Moreover, the width W may be generally equal to a corresponding width of at least the immediately downstream mixing baffle 24. Further, the height H may be less than a corresponding height of at least the immediately downstream mixing baffle 24. This height differential defines an upper fluid slot 76 extending laterally across the top 58 of the entry mixing element 22 and opening laterally to the upper fluid gate 72, and a lower fluid slot 78 extending laterally across the bottom 62 of the entry mixing element 22 and opening laterally to the lower fluid gate 74.

It will be appreciated that the entry mixing element 22 may be formed with a height H and a width W having various alternative relationships with one another, and with the corresponding height and width of the immediately downstream mixing baffle 24, suitable to define first and second fluid slots similar to the upper and lower fluid slots 76, 78 shown and described herein.

As best shown in FIG. 8, a downstream side of the upper front panel portion 54 defines an upper deflecting surface 80 extending vertically upward from the upper surface 40 of the entry dividing wall 34. Similarly, a downstream side of the lower front panel portion 56 defines a lower deflecting surface 82 extending vertically downward from the lower surface of the entry dividing wall 34. Each of the deflecting surfaces 80, 82 includes first and second planar surfaces 84, 86 oriented at different angles relative to the fluid flow, the second planar surface 86 being oriented at a sharper angle to the fluid flow than the first planar surface 84.

Having described the structural features of the exemplary entry mixing element 22, directional movements imparted by the entry mixing element 22 on an incoming two-component flow F directed into the static mixer 10 will now be described.

As the fluid flow F is introduced into the static mixer 10 through the inlet 16 of the conduit 14, the fluid flow F contacts the planar front surface 52 of the entry mixing element 22. The fluid flow F is then divided horizontally by the leading edge 36 of the entry dividing wall 34, and vertically by the inner edges of the front panel portion bodies 66, into an upper fluid flow portion and a lower fluid flow portion, each containing an amount of each of the components of the original incoming fluid flow F. For example, the upper fluid flow portion may contain a first amount of the first component of the fluid flow F and a first amount of a second component of the fluid flow F. Meanwhile, the lower fluid flow portion may contain a second amount of the first component, and a second amount of the second component. Accordingly, each of the components of the incoming fluid flow F is divided by the entry mixing element 22. As described above, the unique structural configuration of the entry mixing element 22 enables similar division of the incoming fluid flow components regardless of the rotational orientation of the mixing component 12, and its entry mixing element 22, relative to the transverse flow cross-section of the incoming fluid flow F.

The upper fluid flow portion is then compressed and directed through the upper fluid gate 72 and the upper fluid slot 76, while the lower fluid flow portion is compressed and directed through the lower fluid gate 74 and the lower fluid slot 78. While passing through the upper fluid gate 72, the upper fluid flow portion flows across the upper surface 40 of the entry dividing wall 34 and expands laterally to contact the upper deflecting surface 80. Simultaneously, while passing through the lower fluid gate 74, the lower fluid flow portion flows across the lower surface of the entry dividing wall 34 and expands laterally to contact the lower deflecting surface 82.

After expanding laterally, the upper and lower fluid flow portions advance toward the trailing edge 38 of the entry dividing wall 34. The first hook section 46 guides the lower fluid flow portion upwardly, and the second hook section 48 guides the upper fluid flow portion downwardly, thereby recombining the upper and lower fluid flow portions. The recombined fluid flow then advances downstream toward the mixing baffles 24 for further mixing.

Advantageously, the upper and lower fluid slots 76, 78 defined by the entry mixing element 22 increase an exposure of the fluid flow to upper and lower dividing hook sections 88, 90, or similar fluid dividing elements, formed on the leading edge of a mixing baffle 24 arranged downstream, as best in FIGS. 3 and 6. More specifically, the upper fluid slot 76 is aligned with and directs the upper fluid flow portion toward an outer tip of the upper hook section 88, and lower fluid slot 78 is aligned with and directs the lower fluid flow portion toward an outer tip of the lower hook section 90. This direct exposure of the upper and lower fluid flow portions to the hook sections 88, 90 of the downstream mixing baffle 24 enables enhanced mixing of the first and second fluid components downstream of the entry mixing element 22, and thereby reduces the undesirable streaking effect described above.

Figure 9B:
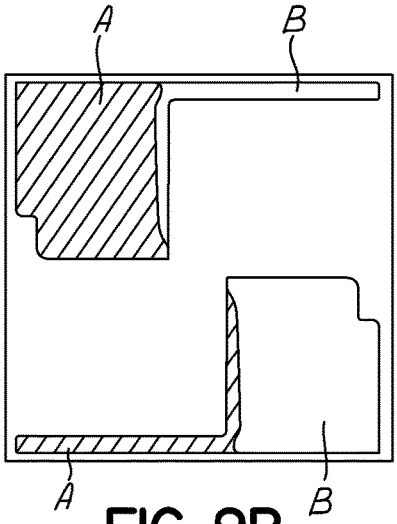
FIG. 9B is a flow cross-section taken at line 9B-9B shown in FIG. 3.
Figure 9C:
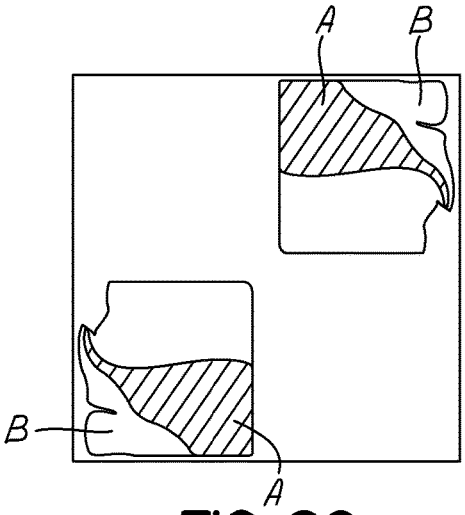
FIG. 9C is a flow cross-section taken at line 90-90 shown in FIG. 3.
Figure 9D:
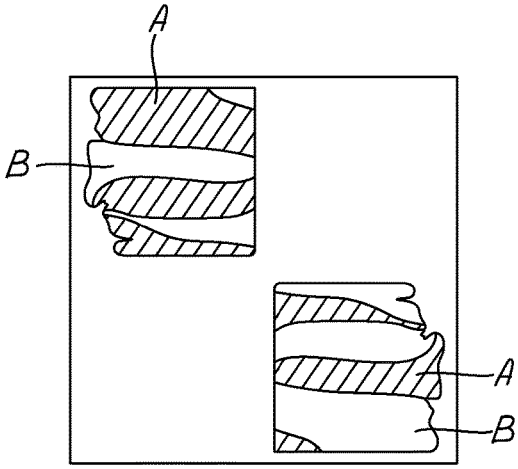
FIG. 9D is a flow cross-section taken at line 9D-9D shown in FIG. 3.
Figure 10:
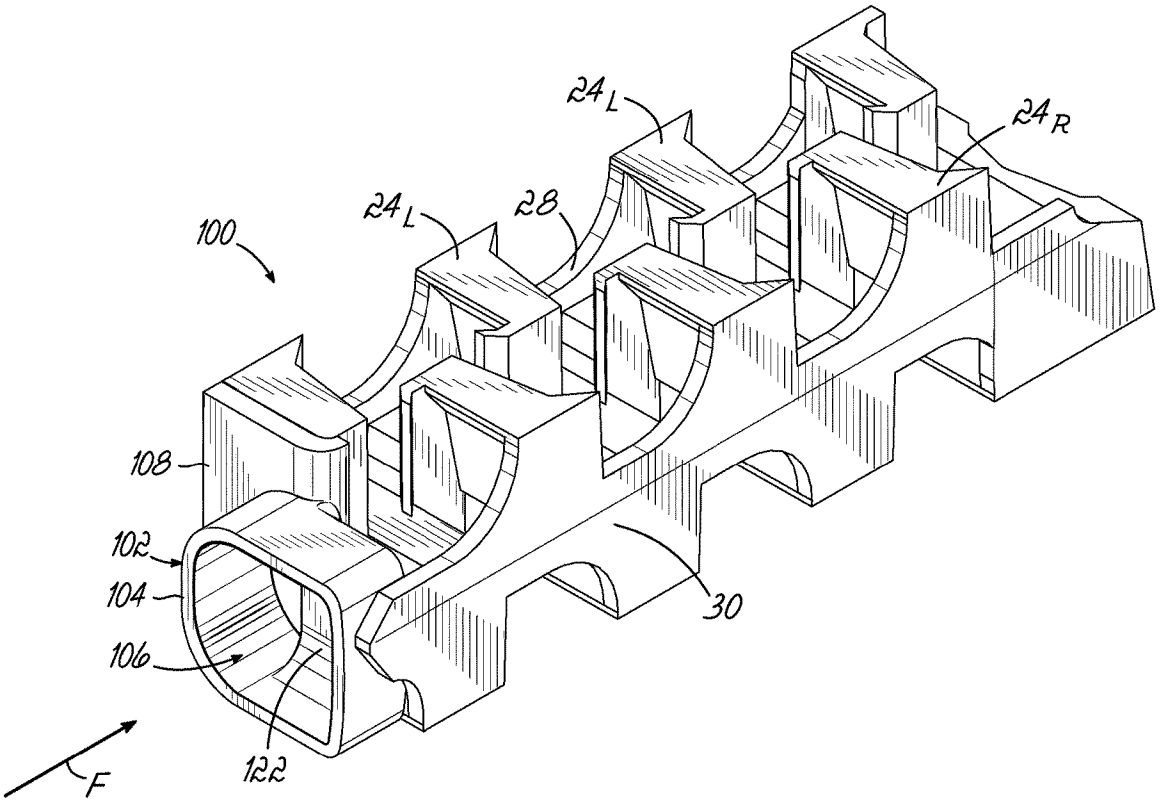
FIG. 10 is a front perspective view of a mixing component having an entry mixing element according to another exemplary embodiment of the invention.
Figure 11:
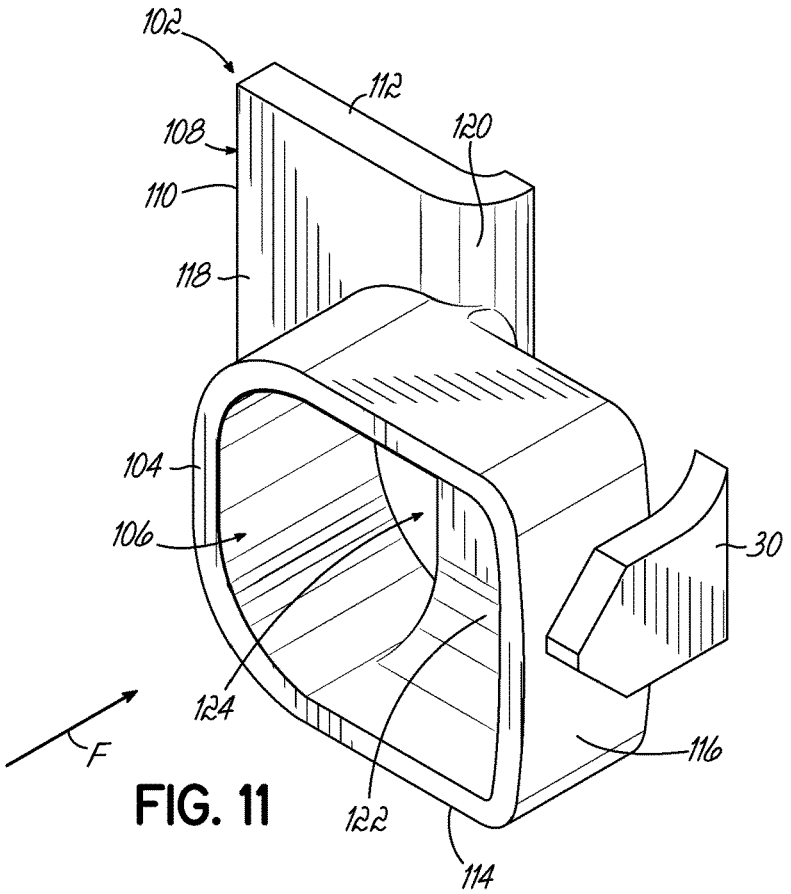
FIG. 11 is a front perspective view of the entry mixing element of FIG. 10.
Figure 12:
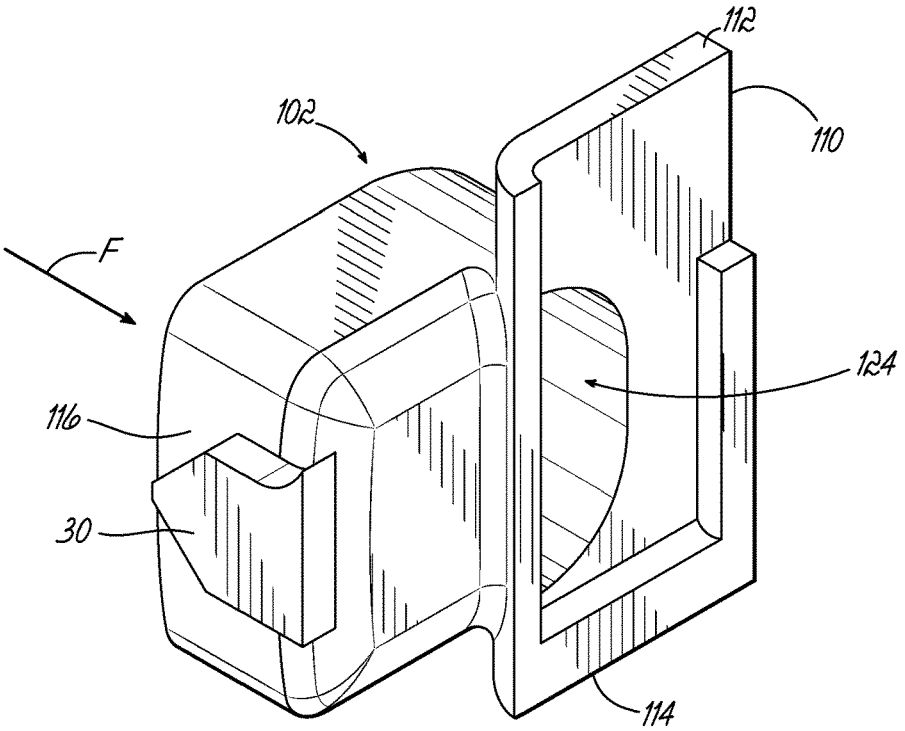
FIG. 12 is a rear perspective view of the entry mixing element of FIG. 10.
Figure 13:
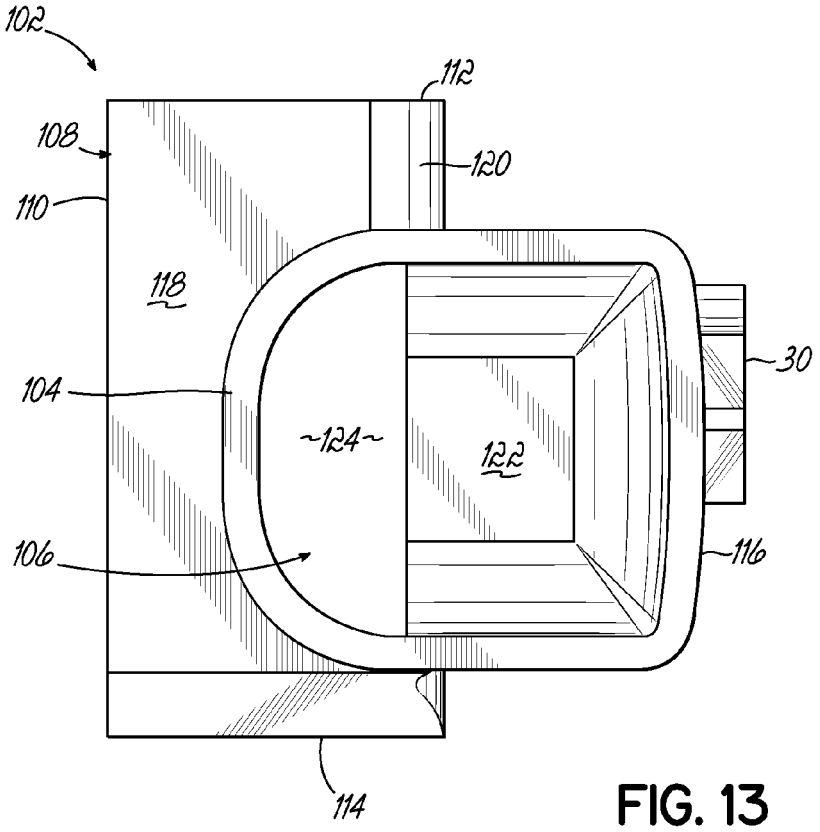
FIG. 13 is a front elevation view of the entry mixing element of FIG. 10.
Figure 14:
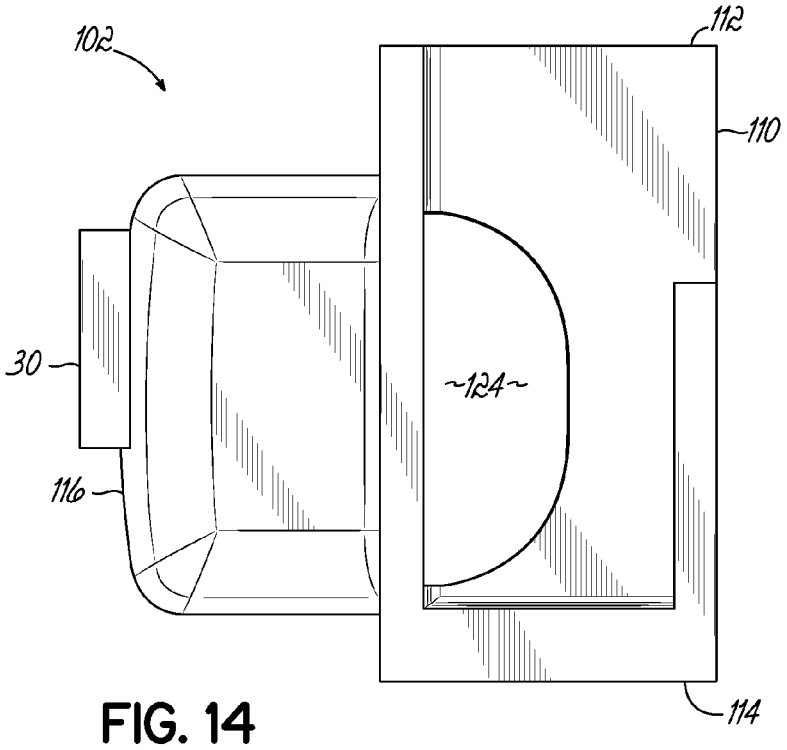
FIG. 14 is a rear elevation view of the entry mixing element of FIG. 10.

In illustration of the general flow description provided above, FIGS. 9A-9D schematically show a series of flow cross-sections taken for a sample fluid flow directed through the mixing component 12 of the static mixer 10. The flow cross-sections are taken generally transverse to a flow direction of the fluid flow. The sample fluid flow shown has a 1:1 volume ratio of first and second fluid components A, B. The specific locations along the mixing component 12 at which the flow cross sections are taken are indicated in FIG. 3. To that end, FIGS. 9A and 9B show flow cross sections corresponding to positions along the entry mixing element 22, while FIGS. 9C and 9D show flow cross sections corresponding to positions along the mixing baffles 24 arranged downstream of the entry mixing element 22.

As shown in FIG. 9A, and as represented in phantom in FIG. 3, the two fluid components A, B of the incoming fluid flow are unmixed as they approach the front panel 50 of the entry mixing element 22. FIG. 9B shows the fluid flow after having been divided by the entry dividing wall 34 and the planar front panel 50 into upper and lower fluid flow portions, and now passing through the upper and lower fluid gates 72, 74 and the upper and lower fluid slots 76, 78. In particular, component A is divided to pass through the upper fluid gate 72 and the lower fluid slot 78, while component B is divided to pass through the lower fluid gate 74 and the upper fluid slot 76. Accordingly, each of the fluid flow components A, B has been divided by the entry mixing element 22 into upper and lower flow portions.

Based on the exemplary rotational orientation of the mixing component 12 relative to the two fluid components A, B shown in the Figures, it will be evident to those skilled in the art that the entry mixing element 22 is effective to divide each of the components A, B into at least first and second portions regardless of the rotational orientation of the mixing component 12 relative to the transverse flow cross-section defined by the components A, B. Moreover, while the sample fluid flow of FIGS. 9A-9D is shown having a 1:1 volume ratio of component A to component B, it will be appreciated that the mixing component 12, including the entry mixing element 22, will similarly mix fluid flows having various alternative volume ratios of first and second components, ranging from 1:1 up to and including 10:1, for example. The same will be appreciated for the alternative embodiments described herein.

As the initially mixed fluid flow advances downstream from the entry mixing element 22, it is mixed further by the mixing baffles 24 so as to progressively increase the quantity of layers of components A, B in the fluid flow portions, and simultaneously decrease the thickness of each layer, as illustrated in FIGS. 9C and 9D, for example. In this manner, the two fluid components A, B are mixed together to form a generally homogenous mixture to be extruded from the static mixer 10 without streaks of unmixed fluid components.

Additional mixing elements according to exemplary alternative embodiments of the invention are described below in connection with FIGS. 10-24. Similar to the entry mixing element 22, each of the exemplary alternative mixing elements ensures some initial division and mixing of each of the multiple components of an incoming fluid flow, regardless of the rotational orientation of the entry mixing element, about a central axis of the mixing component, relative to a transverse flow cross-section of the incoming fluid flow. More specifically, regardless of the rotational orientation of the entry mixing element relative to the flow cross-section, an entry dividing wall of the entry mixing element divides the incoming fluid flow into an inner fluid flow portion and an outer fluid flow portion that surrounds the inner fluid flow portion. Each of the inner and outer fluid flow portions contains an amount of the first fluid component of the incoming fluid flow, and an amount of the second fluid component of the incoming fluid flow.

Referring to FIGS. 10-14, a mixing component 100 having an entry mixing element 102 according to another exemplary embodiment of the invention is shown. The entry mixing element 102 includes an entry dividing wall 104 that extends along an axial direction of the mixing component 100, and circumferentially so as to divide in the incoming fluid flow F into an inner fluid flow portion and an outer fluid flow portion that surrounds the inner fluid flow portion.

The entry dividing wall 104 defines an opening 106 through which the inner fluid flow portion is directed. The entry dividing wall 104 may be formed so as to define the opening 106 with a closed cross-sectional shape. Accordingly, the entry dividing wall 104 fully surrounds the inner fluid flow portion, and fully separates the inner fluid flow portion from the outer fluid flow portion. As shown in FIGS. 10-14, the entry dividing wall 104 may be formed with a cross-section having a generally reverse-D shape, thereby providing the opening 106 with a similar shape. As shown best in FIGS. 10 and 13, the entry dividing wall 104 may extend from an inlet end of the mixing component 100 such that a center of the opening 106 is laterally offset from a central axis of the mixing component 100 and a corresponding axial center of the entry mixing element 102.

The entry dividing wall 104 projects axially outward from a back wall 108 of the entry mixing element, the back wall 108 being formed integrally with, or otherwise coupled to, a downstream mixing baffle 24. The back wall 108 is formed primarily at the left half of the entry mixing element 102 and extends radially outward from the entry dividing wall 104 so as to define a left side 110, a top 112, and a bottom 114 of the entry mixing element 102. The entry dividing wall 104 defines a right side 116 of the entry mixing element 102. The back wall 108 includes a planar portion 118 extending laterally inward from the left side 110 toward the axial center of the entry mixing element 102, and a curved portion 120 extending from the planar portion 118 in the downstream direction. The planar and curved portions 118, 120 of the back wall 108 are positioned to deflect the outer fluid flow portion in the downstream direction.

An inner deflecting wall 122 joins upper, lower, and right-side portions of the entry dividing wall 104, and may be rounded at the junctions of these dividing wall portions to funnel the inner fluid flow portion through an inner passage 124 that extends through the back wall 108. The inner deflecting wall 122 and an inner surface of the entry dividing wall 104 may be shaped so as to form the inner passage 124 with a generally reverse D-shape as well.

In use, referring primarily to FIGS. 11-14, an incoming fluid flow having first and second fluid components is directed toward the entry mixing element 102, and is divided by the entry dividing wall 104 into an inner fluid flow portion and an outer fluid flow portion that surrounds the inner fluid flow portion. More specifically, the incoming fluid flow is divided such that each of the inner fluid flow portion and the outer fluid flow portion contains an amount of the first fluid component and an amount of the second fluid component.

The inner fluid flow portion passes through the opening 106 of the entry dividing wall 104 and toward the inner passage 124. A section of the inner fluid flow portion may contact the inner deflecting wall 122, the inner curvature of which funnels the inner fluid flow portion toward and through the inner passage 124. Simultaneously, the outer fluid flow portion passes outwardly of the entry dividing wall 104, so as to surround the inner fluid flow portion. A section of outer fluid flow portion may contact the planar and curved portions 118, 120 of the back wall 108, which deflect the outer fluid flow portion inwardly toward a central axis of the mixing component 100, and downstream. At the downstream side of the entry mixing element 102, shown in FIGS. 12 and 14, the inner and outer fluid flow portions are recombined before passing to a downstream mixing baffle 24 for further mixing.

Figure 15A:
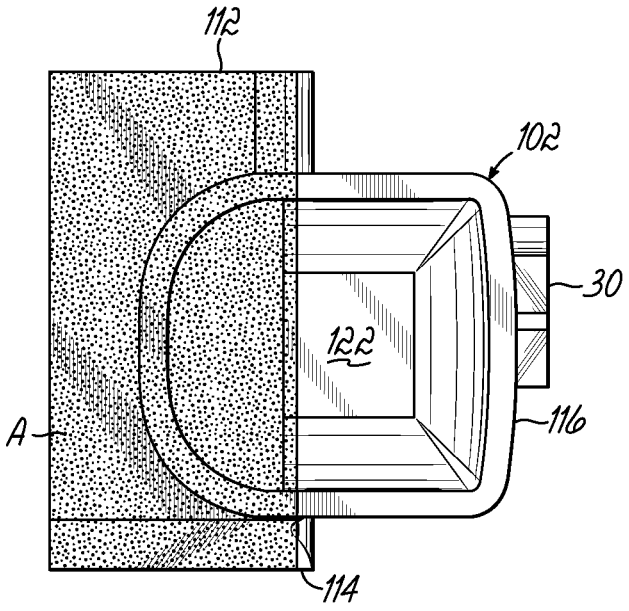
FIG. 15A is a front elevation view of the entry mixing element of FIG. 10, shown in a first rotational orientation relative to an incoming two-component fluid flow having a 1:1 component volume ratio and a first component shown in shading.
Figure 15B:
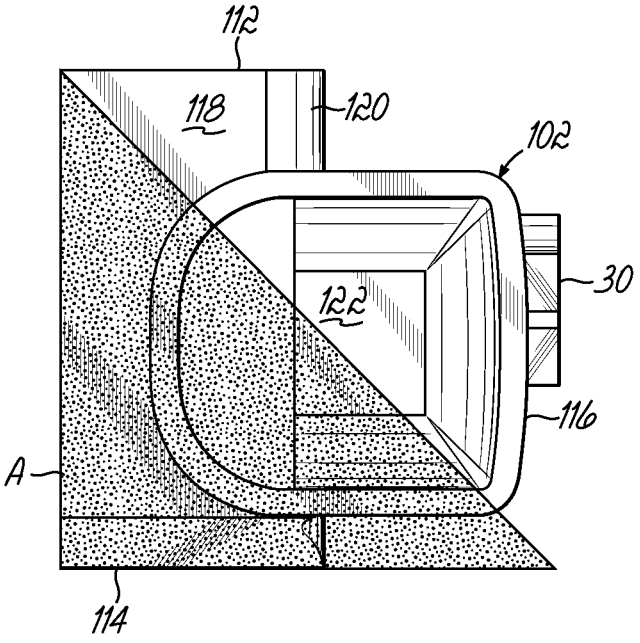
FIG. 15B is a front elevation view similar to FIG. 15A, showing the entry mixing element in a second rotational orientation relative to the incoming fluid flow.
Figure 15C:
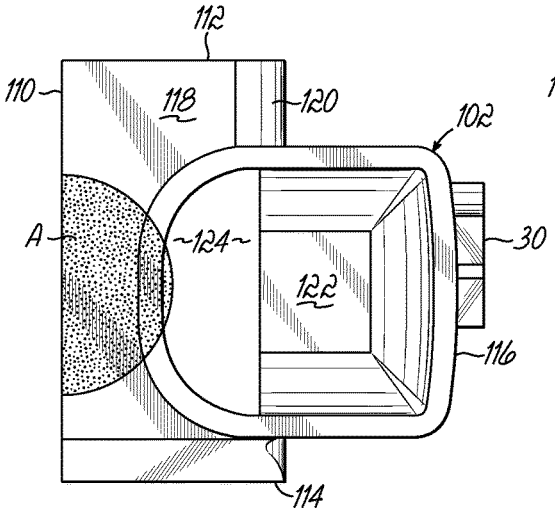
FIG. 15C is a front elevation view of the entry mixing element of FIG. 10, shown in a first rotational orientation relative to an incoming two-component fluid flow having a 10:1 component volume ratio and a first component shown in shading.
Figure 15D:
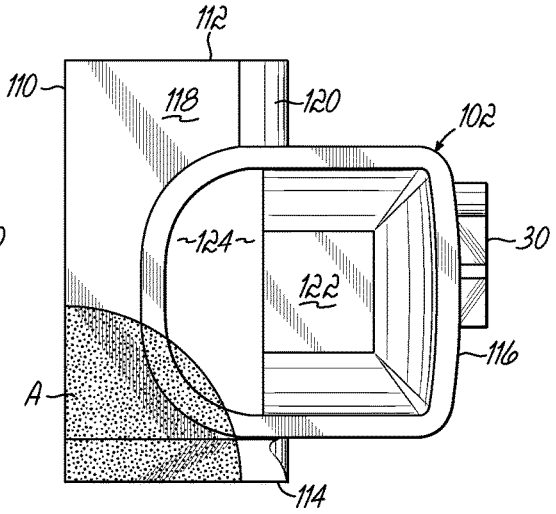
FIG. 15D is a front elevation view similar to FIG. 15C, showing the entry mixing element in a second rotational orientation relative to the incoming fluid flow.
Figure 15E:
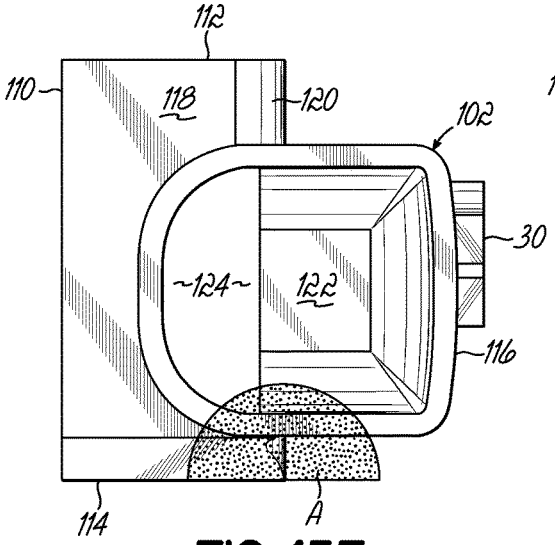
FIG. 15E is a front elevation view similar to FIG. 15D, showing the entry mixing element in a third rotational orientation relative to the incoming fluid flow.
Figure 15F:
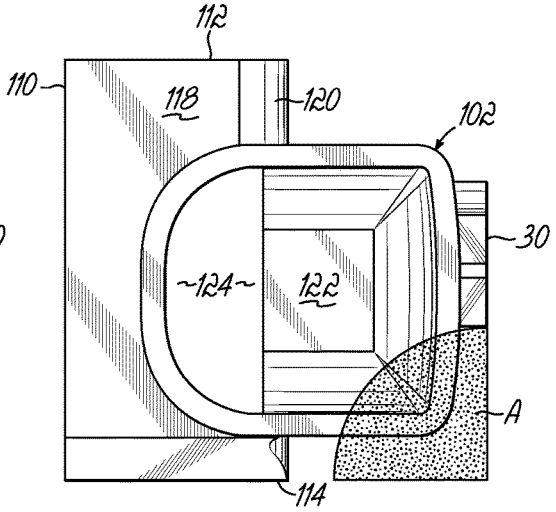
FIG. 15F is a front elevation view similar to FIG. 15E, showing the entry mixing element in a fourth rotational orientation relative to the incoming fluid flow.

Referring to FIGS. 15A and 15B, the entry mixing element 102 is shown in first and second exemplary rotational orientations, respectively, relative to a transverse flow cross-section of an incoming fluid flow. The fluid flow is shown having a 1:1 component volume ratio of first and second fluid components, the first fluid component (labeled A) shown in shading. The second fluid component may occupy at least a majority of the flow cross-section not occupied by the first component (see, e.g., FIG. 9A). As shown in FIGS. 15A and 15B, regardless of the rotational orientation of the entry mixing element 102 relative to the transverse flow cross-section, the entry dividing wall 104 divides each of the first and second fluid components between the inner fluid flow portion and the outer fluid flow portion.

Referring to FIGS. 15C-15F, the entry mixing element 102 is shown in four exemplary rotational orientations relative to a transverse flow cross-section of an incoming fluid flow. The fluid flow is shown having a 10:1 component volume ratio of first and second fluid components, the first component (labeled A) shown in shading. Again, regardless of the rotational orientation of the entry mixing element 102 relative to the transverse flow cross-section, the entry dividing wall 104 divides each of the first and second fluid components between the inner fluid flow portion and the outer fluid flow portion.

Referring to FIGS. 16-21, a mixing component 130 having an entry mixing element 132 according to another exemplary embodiment of the invention is shown. Similar to entry mixing element 102 of FIGS. 10-15F, entry mixing element 132 includes an entry dividing wall 134 that extends along an axial direction of the mixing component 130, and circumferentially so as to divide the incoming fluid flow F into an inner fluid flow portion and an outer fluid flow portion that surrounds the inner fluid flow portion.

Figure 16:
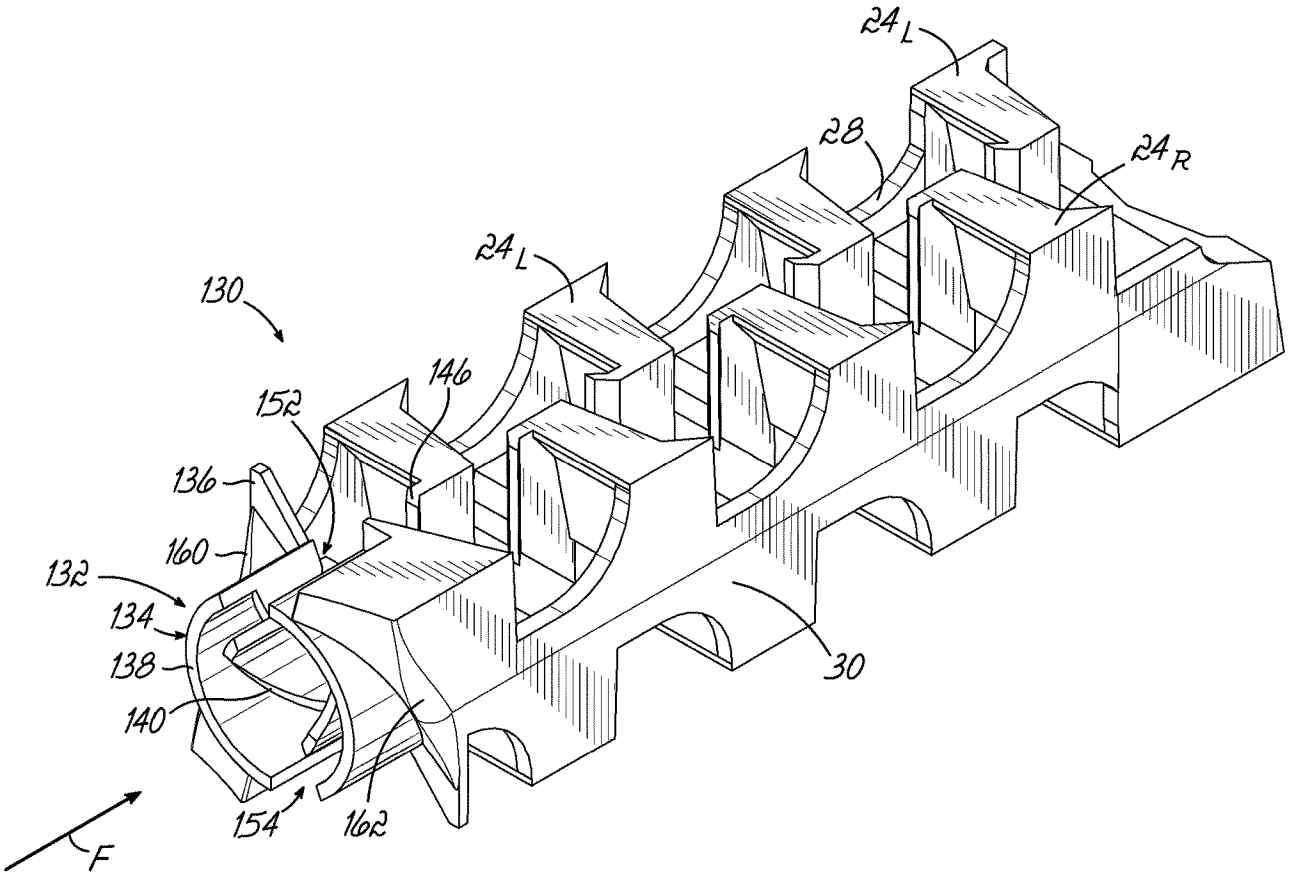
FIG. 16 is a front perspective view of a mixing component having an entry mixing element according to another exemplary embodiment of the invention.
Figure 17:
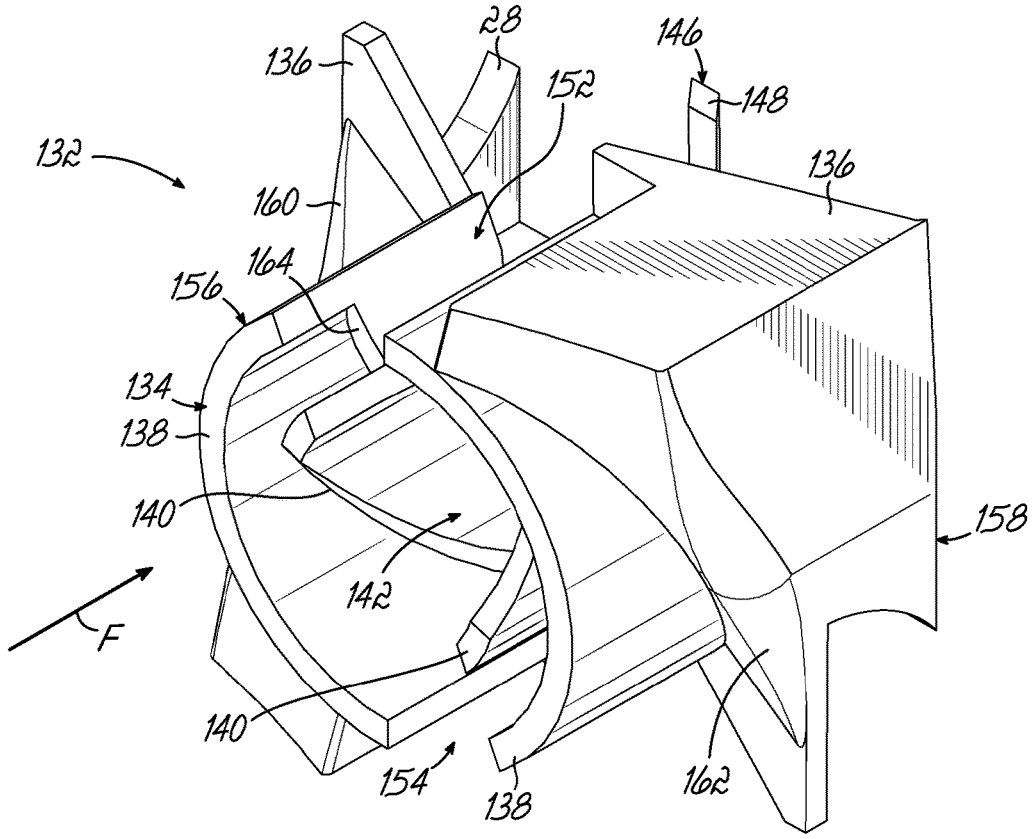
FIG. 17 is a front perspective view of the entry mixing element of FIG. 16.
Figure 18:
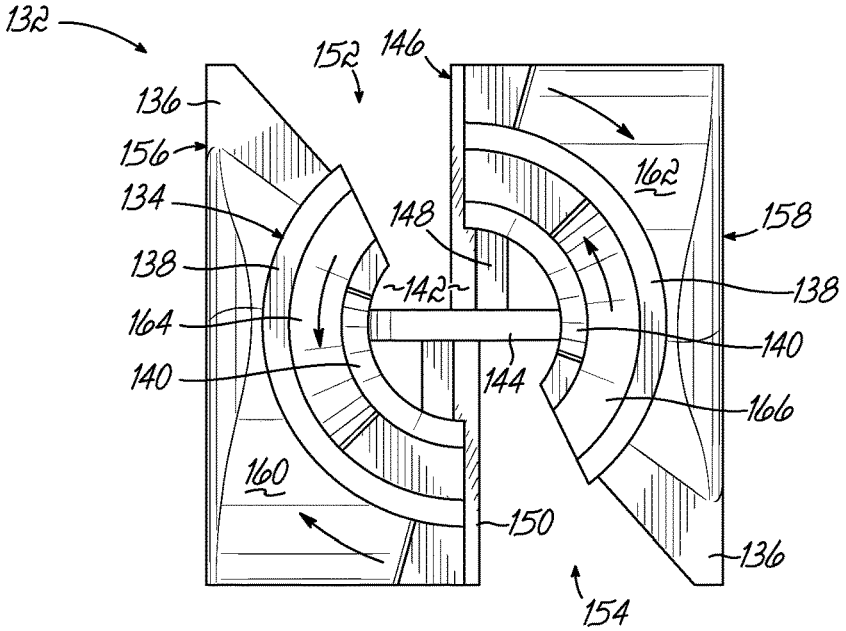
FIG. 18 is a front elevation view of the entry mixing element of FIG. 16.

As shown best in FIGS. 17 and 18, the entry dividing wall 134 is generally annular and projects axially outward from a back wall structure 136. The entry dividing wall 134 includes a generally annular outer dividing wall section 138 and a generally annular inner dividing wall section 140 positioned radially inward of and surrounded by the outer dividing wall section 138. The inner dividing wall section 140 defines a circular central opening 142 that directs fluid toward a horizontal dividing panel 144 and a vertical dividing panel 146 extending from the back wall structure 136, as shown best in FIGS. 18 and 19. The vertical dividing panel 146 includes upper and lower hook sections 148, 150 that extend angularly in an upstream direction to define a leading edge of the vertical dividing panel 146. In an embodiment, the vertical dividing panel 146 and its hook sections 148, 150 may be formed integrally with a downstream mixing baffle 24, as shown in FIG. 16.

Figure 19:
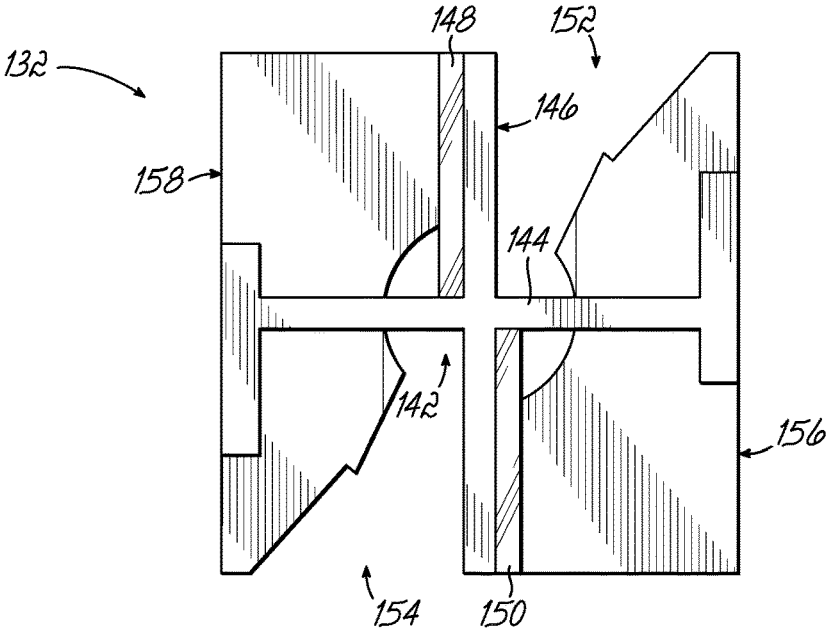
FIG. 19 is a rear elevation view of the entry mixing element of FIG. 16.

An upper fluid gate 152 extends radially inward through an upper left quadrant of the back wall structure 136 and the entry dividing wall 134, and opens to the central opening 142. Similarly, a lower fluid gate 154 extends radially inward through a lower right quadrant of the back wall structure 136 and the entry dividing wall 134, and opens to the central opening 142. Each of the upper and lower fluid gates 152, 154 may taper in width as the fluid gate 152, 154 approaches the central opening 142. Consequently, the upper and lower fluid gates 152, 154 divide the back wall structure 136 and the entry dividing wall 134 into a left portion 156 and a right portion 158, joined together by the horizontal and vertical dividing panels 144, 146 at the downstream side of the entry mixing element 132, as shown in FIGS. 18-20.

As shown best in FIGS. 17 and 18, the back wall structure 136 is shaped to impart a clockwise rotation to the outer fluid flow portion, and the entry dividing wall 134 is shaped to impart a counter-clockwise rotation to an outer section of the inner fluid flow portion. More specifically, the back wall structure 136 includes a first outer baffle 160 formed on the left portion 156 of the entry mixing element 132, and a second outer baffle 162 formed on the right portion 158 of the entry mixing element 132. The outer baffles 160, 162 are each sloped to deflect the outer fluid flow in a clockwise rotational direction, as indicated by directional arrows in FIG. 18.

The entry dividing wall 134 is formed with a first inner baffle 164 that extends annularly between the inner dividing wall section 140 and the outer dividing wall section 138 on the left portion 156 of the entry mixing element 132. A second inner baffle 166 extends annularly between the inner dividing wall section 140 and the outer dividing wall section 138 on the right portion 158 of the entry mixing element 132. The inner baffles 164, 166 are each sloped to deflect an outer section of the inner fluid flow portion in a counter-clockwise rotational direction, as indicated by directional arrows in FIG. 18. As described above, the innermost section of the inner fluid flow portion passes unimpeded through the central opening 142 defined by the inner dividing wall section 140, until it contacts the horizontal and vertical dividing panels 144, 146 at the downstream side of the entry mixing element 132.

Figure 20:
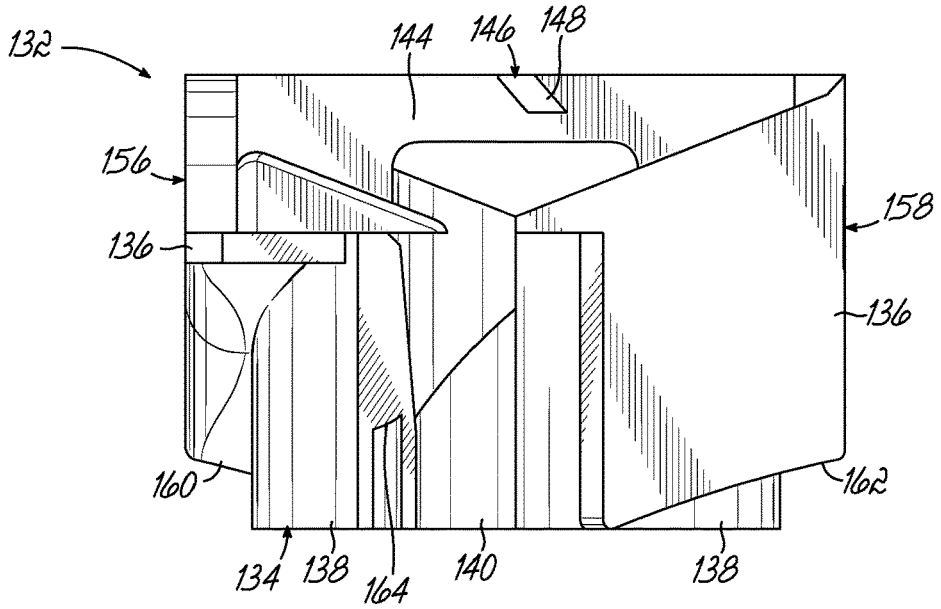
FIG. 20 is a top view of the entry mixing element of FIG. 16.
Figure 21:
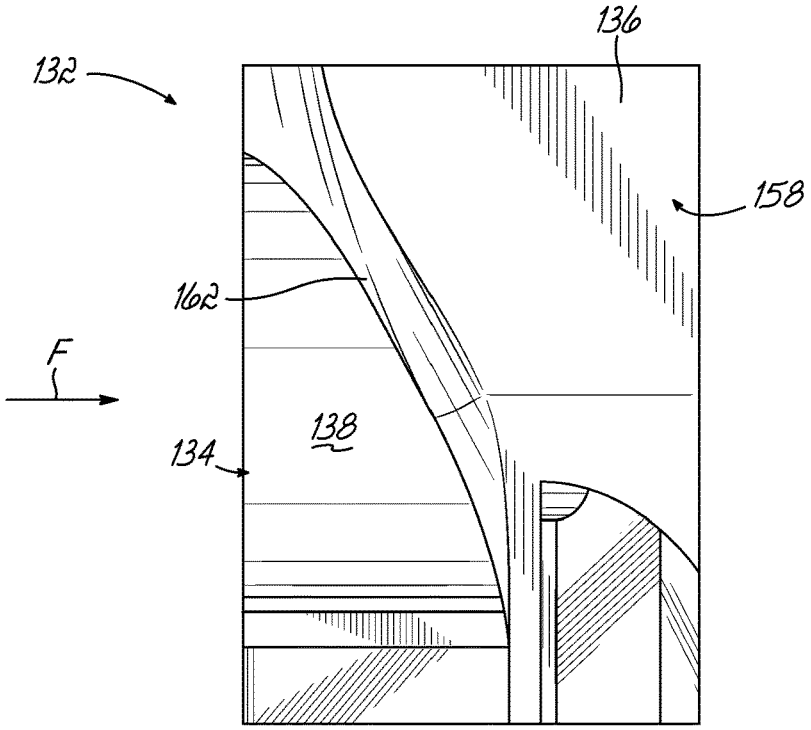
FIG. 21 is a side elevation view of the entry mixing element of FIG. 16.

FIGS. 20 and 21 show top and right side views, respectively, of the entry mixing element 132, and illustrate additional structural details of the entry dividing wall 134 and the back wall structure 136, described above. For example, as shown in FIG. 20, the leading edge of the vertical dividing panel 146, defined by the upper and lower hook sections 148, 150, may be positioned downstream of a leading edge of the horizontal dividing panel 144.

In use, referring primarily to FIGS. 17-19, an incoming fluid flow having first and second fluid components is directed toward the entry mixing element 132. The incoming fluid flow is divided by the outer dividing wall section 138 into an inner fluid flow portion that passes radially inward of the outer dividing wall section 138, and an outer fluid flow portion that passes radially outward of the outer dividing wall section 138 and surrounds the inner fluid flow portion. Each of the inner and outer fluid flow portions has an amount of the first fluid component and an amount of the second fluid flow component.

The inner dividing wall section 140 further divides the inner fluid flow portion into an outer fluid section that passes between the inner and outer dividing wall sections 138, 140, and an innermost fluid section that passes radially inward of the inner dividing wall section 140, through the central opening 142. The outer fluid section is then deflected in a counter-clockwise direction by the first and second inner baffles 164, 166. More specifically, the first inner baffle 164 directs a corresponding portion of the outer fluid section toward and through the lower fluid gate 154, and the second inner baffle 166 directs a corresponding portion of the outer fluid section toward and through the lower fluid gate 154. Simultaneously, the innermost fluid section of the inner fluid flow portion passes unimpeded through the central opening 142, and may be at least partially recombined with the outer fluid section at a location upstream from the horizontal and vertical dividing panels 144, 146.

While the inner fluid flow portion of the fluid flow is being directed as generally described above, the outer fluid flow portion is deflected in a clockwise direction by the first and second outer baffles 160, 162. More specifically, the first outer baffle 160 directs a corresponding portion of the outer fluid flow portion toward and through the upper fluid gate 152, and the second outer baffle 162 directs a corresponding portion of the outer fluid flow portion toward and through the lower fluid gate 154. Consequently, the outer fluid flow portion may be recombined at least in part with at least the outer section of the inner fluid flow portion, at a location upstream from the horizontal and vertical dividing panels 144, 146.

While the entry mixing element 132 is shown and described as imparting a clockwise rotation to the outer fluid flow portion and a counter-clockwise rotation to the inner fluid flow portion, it will be appreciated that the inner and outer baffles 160, 162, 164, 166 may be shaped so as to impart various alternative rotational effects on the fluid flow portions.

As the inner and outer fluid flow portions are directed downstream through the upper and lower fluid gates 152, 154 through the central opening 142, as generally described above, at least the innermost fluid section of the inner fluid flow portion may be further divided into upper and lower portions by the horizontal dividing panel 144. The upper portion may be further divided vertically by the upper hook section 148 of the vertical dividing panel 146, and the lower portion may be further divided vertically by the lower hook section 150 of the vertical dividing panel 146. The mixture of various fluid flow portions flowing downstream from the entry mixing element 132 is then mixed further by the mixing baffles 24 of the mixing component 130.

Figure 22A:
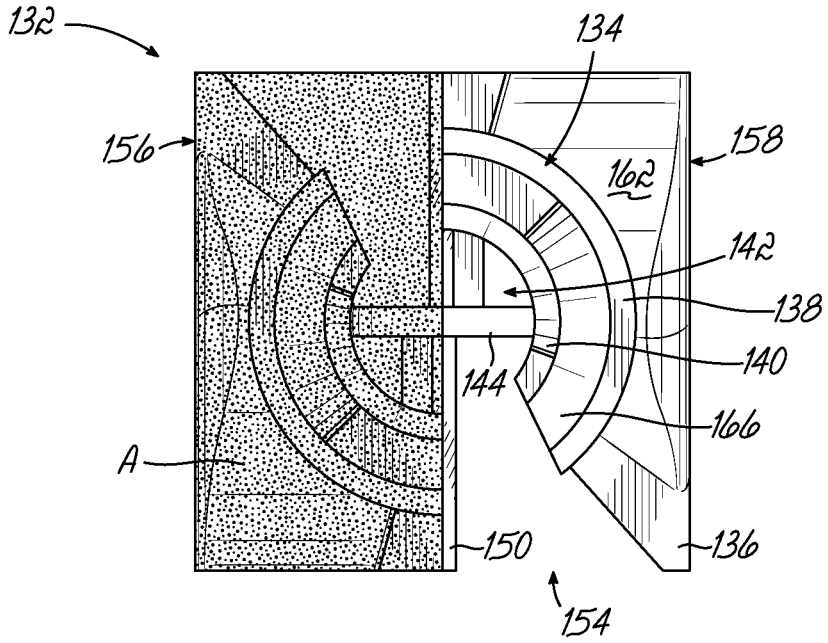
FIG. 22A is a front elevation view of the entry mixing element of FIG. 16, shown in a first rotational orientation relative to an incoming two-component fluid flow having a 1:1 component volume ratio and a first component shown in shading.
Figure 22B:
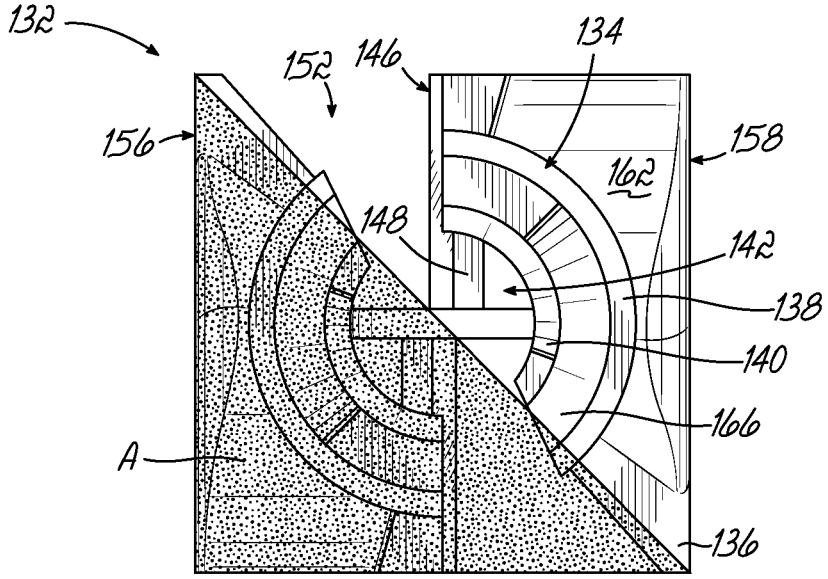
FIG. 22B is a front elevation view similar to FIG. 22A, showing the entry mixing element in a second rotational orientation relative to the incoming fluid flow.
Figure 22C:
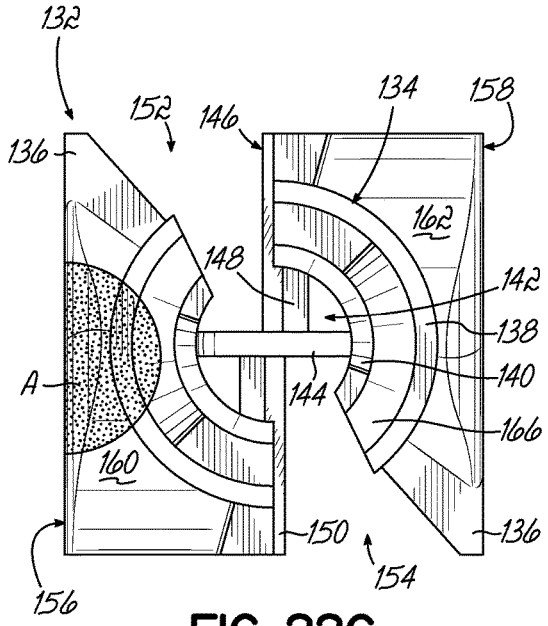
FIG. 22C is a front elevation view of the entry mixing element of FIG. 16, shown in a first rotational orientation relative to an incoming two-component fluid flow having a 10:1 component volume ratio and a first component shown in shading.
Figure 22D:
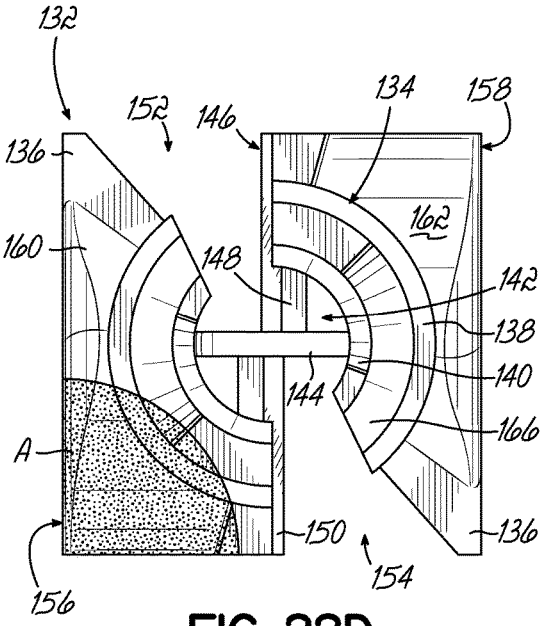
FIG. 22D is a front elevation view similar to FIG. 22C, showing the entry mixing element in a second rotational orientation relative to the incoming fluid flow.
Figure 22E:
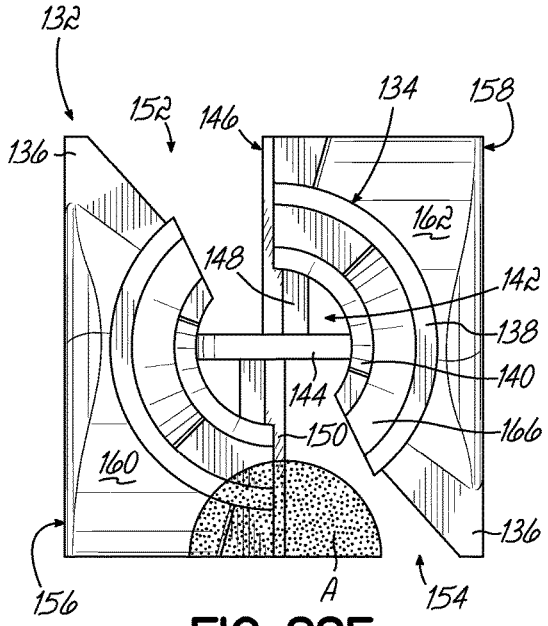
FIG. 22E is a front elevation view similar to FIG. 22D, showing the entry mixing element in a third rotational orientation relative to the incoming fluid flow.
Figure 22F:
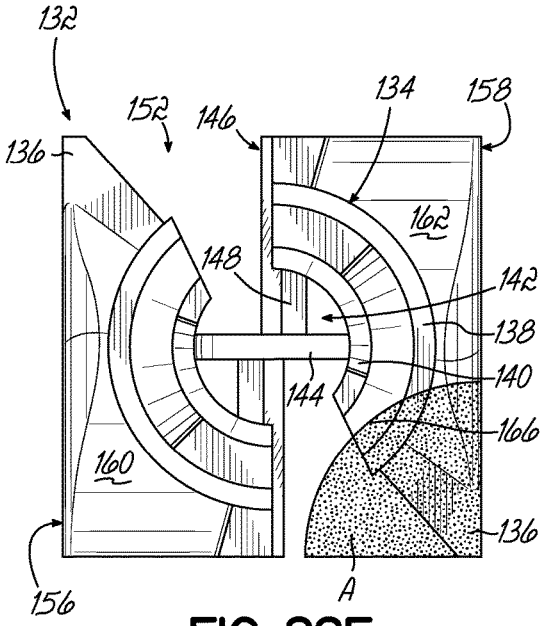
FIG. 22F is a front elevation view similar to FIG. 22E, showing the entry mixing element in a fourth rotational orientation relative to the incoming fluid flow.

Referring to FIGS. 22A and 22B, the entry mixing element 132 is shown in first and second exemplary rotational orientations, respectively, relative to a transverse flow cross-section of an incoming fluid flow. The fluid flow is shown having a 1:1 component volume ratio of first and second fluid components, the first component (labeled A) shown in shading. The second fluid component may occupy at least a majority of the flow cross-section not occupied by the first fluid component (see, e.g., FIG. 9A). As shown in FIGS. 22A and 22B, regardless of the rotational orientation of the entry mixing element 132 relative to the transverse flow cross-section, the outer dividing wall section 138 divides each of the first and second fluid components between the inner fluid flow portion and the outer fluid flow portion, as described above.

Referring to FIGS. 22C-22F, the entry mixing element 132 is shown in four exemplary rotational orientations relative to a transverse flow cross-section of an incoming fluid flow. The fluid flow is shown having a 10:1 component volume ratio of first and second fluid components, the first component (labeled A) shown in shading. Again, regardless of the rotational orientation of the entry mixing element 132 relative to the transverse flow cross-section, the entry dividing wall 134 divides each of the first and second fluid components between the inner fluid flow portion and the outer fluid flow portion.

Figure 23:
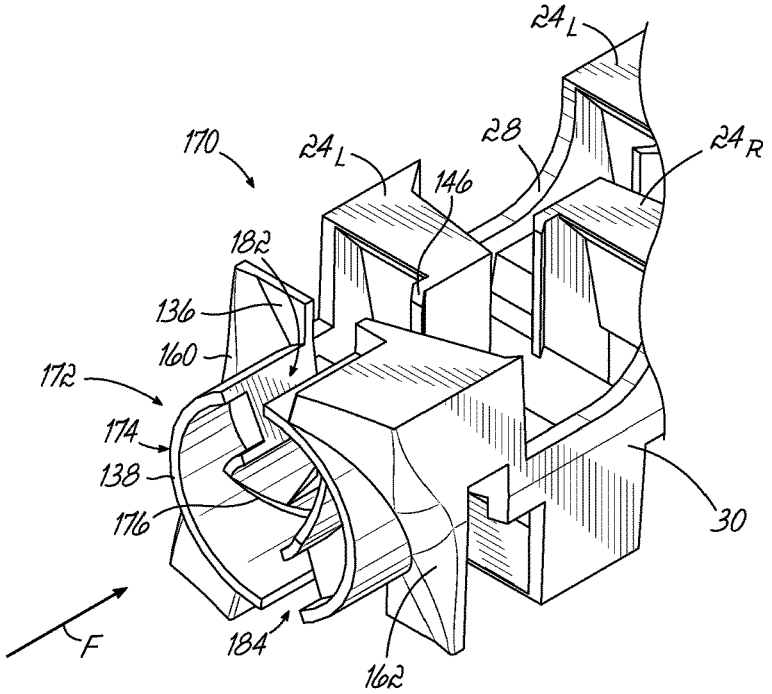
FIG. 23 is a partial front perspective view of a mixing component having an entry mixing element according to another exemplary embodiment of the invention.
Figure 24:
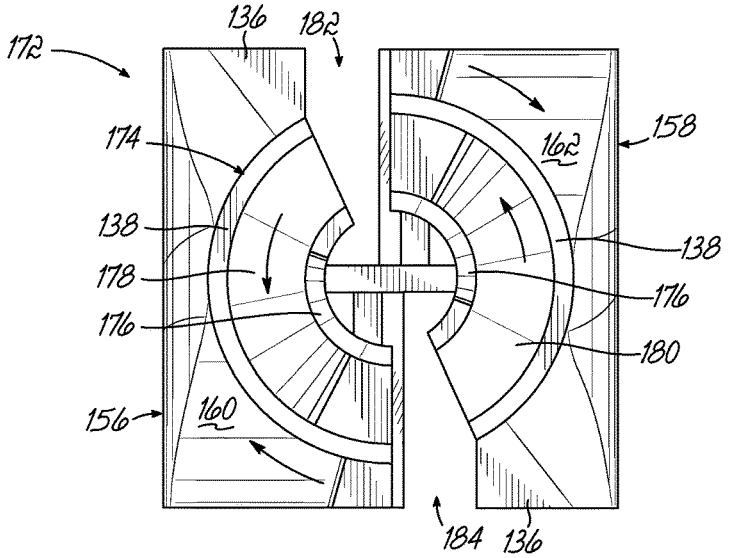
FIG. 24 is a front elevation view of the entry mixing element of FIG. 23.

It will be appreciated that the relative sizing of various features of the entry mixing element 132 may be varied in alternative embodiments. For example, FIGS. 23 and 24 show a mixing component 170 having an entry mixing element 172 according to an exemplary alternative embodiment in which the relating sizing of certain features of the entry mixing element 172 differs from that of entry mixing element 132. In that regard, the entry mixing element 172 is largely similar in structure to entry mixing element 132, as indicated by use of similar reference numerals, except as otherwise described below.

Most notably, the entry dividing wall 174 of entry mixing element 172 includes an inner dividing wall section 176 formed with a generally smaller diameter than the inner dividing wall section 140 of entry mixing element 132. Consequently, a ratio of the outer dividing wall section diameter to the inner dividing wall section diameter is larger for entry mixing element 172 than for entry mixing element 132. To that end, in an exemplary embodiment a dividing wall diameter ratio for entry mixing element 172 may be approximately 2.1:1, while a corresponding dividing wall diameter ratio for the entry mixing element 132 may be approximately 1.7:1. As a result, a radial width of the first and second inner baffles 178, 180 of entry mixing element 172 is larger than a corresponding radial width of first and second inner baffles 164, 166 of entry mixing element 132, as will be appreciated upon comparison of FIGS. 18 and 24, for example.

Additionally, the upper and lower fluid gates 182, 184 of the entry mixing element 172 may be formed with smaller circumferential widths than upper and lower fluid gates 152, 154 of entry mixing element 132. Consequently, the first and second inner baffles 178, 180 of the entry mixing element 172 are formed with larger circumferential lengths than inner baffles 164, 166 of entry mixing element 132, as will be appreciated upon comparison of FIGS. 18 and 24, for example.

While the present invention has been illustrated by the description of specific embodiments thereof, and while the embodiments have been described in considerable detail, it is not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope of the general inventive concept.

What is claimed is:

1. An entry mixing element for mixing an incoming fluid flow having first and second unmixed components arranged to define a transverse flow cross-section perpendicular to a flow direction of the incoming fluid flow, the entry mixing element having a central axis aligned with the flow direction of the incoming fluid flow, the entry mixing element comprising:

an entry dividing wall extending parallel to the central axis; and a planar front panel comprising an upper front panel portion and a lower front panel portion, the planar front panel being arranged at a leading edge of the entry dividing wall and extending generally transverse to the central axis, wherein the entry dividing wall and the planar front panel are positioned to divide the incoming fluid flow into a first fluid flow portion and a second fluid flow portion, each of the first and second fluid flow portions containing an amount of the first component and an amount of the second component, wherein the planar front panel and the entry dividing wall define an upper fluid gate in a first quadrant of the planar front panel through which the first fluid flow portion is directed, and define a lower fluid gate in a second quadrant of the planar front panel through which the second fluid flow portion is directed, wherein the upper front panel portion has a first edge that partially defines the lower fluid gate and a second edge opposite the first edge that partially defines an upper fluid slot that extends from the upper fluid gate, wherein the lower front panel portion has a first edge that partially defines the upper fluid gate and a second edge opposite the first edge that partially defines a lower fluid slot that extends from the lower fluid gate, and wherein the entry dividing wall and the planar front panel are configured to divide the incoming fluid flow into the first and second fluid flow portions in any rotational orientation of the entry mixing element about its central axis relative to the transverse flow cross-section of the incoming fluid flow.

2. The entry mixing element of claim 1, wherein the entry dividing wall and the planar front panel are positioned to divide the incoming fluid flow when the incoming fluid flow has a volume ratio of the first component to the second component ranging from 1:1 to 10:1.

3. The entry mixing element of claim 1, wherein the first fluid flow portion is directed through the upper fluid slot in addition to the upper fluid gate, and the second fluid flow portion is directed through the lower fluid slot in addition to the lower fluid gate.

4. The entry mixing element of claim 3, wherein the planar front panel has a first dimension measured in a first direction transverse to the central axis and a second dimension measured in a second direction transverse to the central axis, the first and second directions being perpendicular to one another, and the first dimension is smaller than the second dimension so as to define the upper and lower fluid slots.

5. A static mixer for mixing a fluid flow having first and second components, the static mixer comprising:

a mixer conduit having an inlet end that receives the first and second components of the fluid flow, and an outlet end that dispenses a mixture of the first and second components; and a mixing component arranged within the mixer conduit and configured to mix the first and second components to form the mixture, wherein the mixing component includes the entry mixing element of claim 1 arranged proximate to and spaced from the inlet end, and a plurality of mixing baffles arranged downstream of the entry mixing element.

6. A method of mixing first and second components of a fluid flow with a static mixer including a mixer conduit and a mixing component having an entry mixing element and a plurality of mixing baffles arranged downstream of the entry mixing element, the method comprising:

introducing the fluid flow having first and second components into an inlet end of the mixer conduit, the first and second components being arranged so as to define a transverse flow cross-section perpendicular to a flow direction of the fluid flow;

forcing the fluid flow into contact with the entry mixing element having a central axis aligned with the flow direction of the fluid flow, wherein the forcing includes:

dividing the fluid flow with an entry dividing wall into a first fluid flow portion and a second fluid flow portion by deflecting the fluid flow with a planar front panel arranged at a leading edge of the entry dividing wall and extending generally transverse to the central axis, the planar front panel comprising an upper front panel portion and a lower front panel portion, each of the first and second fluid flow portions containing an amount of the first component and an amount of the second component, wherein the planar front panel and the entry dividing wall define an upper fluid gate in a first quadrant of the planar front panel through which the first fluid flow portion is directed, and define a lower fluid gate in a second quadrant of the planar front panel through which the second fluid flow portion is directed, wherein the upper front panel portion has a first edge that partially defines the lower fluid gate and a second edge opposite the first edge that partially defines an upper fluid slot that extends from the upper fluid gate, and wherein the lower front panel portion has a first edge that partially defines the upper fluid gate and a second edge opposite the first edge that partially defines a lower fluid slot that extends from the lower fluid gate;

recombining the first and second fluid flow portions to form a mixture of the first and second components; and directing the mixture downstream of the entry mixing element to be mixed further by the plurality of mixing baffles, wherein the entry mixing element is configured to divide the fluid flow into the first and second fluid flow portions in any rotational orientation of the entry mixing element about the central axis relative to the transverse flow cross-section of the fluid flow.

7. The method of claim 6, wherein the entry dividing wall and the planar front panel are configured to divide the fluid flow when the fluid flow has a volume ratio of the first component to the second component ranging from 1:1 to 10:1.

8. The method of claim 6, wherein forcing the fluid flow into contact with the entry mixing element further includes:

directing the first fluid flow portion through the upper fluid gate and the upper fluid slot; and directing the second fluid flow portion through the lower fluid gate and the lower fluid slot.

9. The method of claim 8, wherein directing the first fluid flow portion through the upper fluid gate includes allowing the first flow fluid portion to expand laterally in a first direction across a first side of the entry dividing wall, and directing the second fluid flow portion through the lower fluid gate includes allowing the second flow fluid portion to expand laterally in a second direction across a second side of the entry dividing wall.

10. The method of claim 8, wherein directing the first and second fluid flow portions through the upper and lower fluid slots includes directing the first and second fluid flow portions toward dividing elements provided on at least one of the plurality of mixing baffles arranged downstream of the entry mixing element.

11. The entry mixing element of claim 1, wherein the entry mixing element is configured to recombine the first and second fluid flow portions to form a mixture of the first and second components.

12. The static mixer of claim 5, wherein the entry mixing element is configured to recombine the first and second fluid flow portions to form a mixture of the first and second components.

13. The static mixer of claim 12, wherein the plurality of mixing baffles are configured to further mix the mixture of the first and second components.

* * * * *